US006632296B2

(12) United States Patent
Yoshinaga et al.

(10) Patent No.: US 6,632,296 B2
(45) Date of Patent: Oct. 14, 2003

(54) STEEL PIPE HAVING HIGH FORMABILITY AND METHOD FOR PRODUCING THE SAME

(75) Inventors: Naoki Yoshinaga, Futtsu (JP); Nobuhiro Fujita, Futtsu (JP); Manabu Takahashi, Futtsu (JP); Yasuhiro Shinohara, Futtsu (JP); Tohru Yoshida, Futtsu (JP); Natsuko Sugiura, Futtsu (JP)

(73) Assignee: Nippon Steel Corporation, Tokyo (JP)

( * ) Notice: Subject to any disclaimer, the term of this patent is extended or adjusted under 35 U.S.C. 154(b) by 0 days.

(21) Appl. No.: 10/049,481

(22) PCT Filed: Jun. 7, 2001

(86) PCT No.: PCT/JP01/04800

§ 371 (c)(1),
(2), (4) Date: Feb. 6, 2002

(87) PCT Pub. No.: WO01/94655

PCT Pub. Date: Dec. 13, 2001

(65) Prior Publication Data

US 2003/0131909 A1 Jul. 17, 2003

(30) Foreign Application Priority Data

| | | |
|---|---|---|
| Jun. 7, 2000 | (JP) | 2000-170350 |
| Jun. 7, 2000 | (JP) | 2000-170352 |
| Sep. 18, 2000 | (JP) | 2000-282158 |

(51) Int. Cl.[7] ..... C22C 38/02; C22C 38/04; C21D 8/10

(52) U.S. Cl. ..... 148/320; 148/333; 148/334; 148/335; 148/336; 148/330; 148/332; 148/590; 148/909

(58) Field of Search ..... 148/593, 320, 148/909, 332–336, 330

(56) References Cited

U.S. PATENT DOCUMENTS 5,487,795 A 1/1996 Kim et al.

FOREIGN PATENT DOCUMENTS

| | | |
|---|---|---|
| EP | 0 828 007 | 3/1998 |
| EP | 0924312 | 6/1999 |
| EP | 0 994 197 | 4/2000 |
| JP | 10-175027 | 6/1998 |
| JP | 10-175207 | 6/1998 |

OTHER PUBLICATIONS

Kawabata, Yoshikazu, et al., "Shukukei Atsuen ni yoru Koukan Shogou Shoshiki no Keisei Kikou", Zairyou to Process, Mar. 2001, vol. 14, No. 2, P. 438.

Carleer, B., "Analysis of the Effect of Material Properties on the Hydroforming Process of Tubes", Journal of Materials Processing Technology, vol. 104, pp. 158–166.

English language abstract of WO 01/62998 A1 published Aug. 30, 2001.

*Primary Examiner*—Deborah Yee
(74) *Attorney, Agent, or Firm*—Kenyon & Kenyon

(57) ABSTRACT

The present invention provides a steel pipe excellent in formability during hydraulic forming and the like and a method to produce the same, and more specifically: a steel pipe excellent in formability having an r-value of 1.4 or larger in the axial direction of the steel pipe, and the property that the average of the ratios of the X-ray intensity in the orientation component group of {110}<110> to {332}<110> on the plane at the center of the steel pipe wall thickness to the random X-ray intensity is 3.5 or larger, and/or the ratio of the X-ray intensity in the orientation component of {110}<110> on the plane at the center of the steel pipe wall thickness to the random X-ray intensity is 5.0 or larger; and a method to produce a steel pipe excellent in formability characterized by heating the steel pipe having the property that the ratio of the X-ray intensity in every one of the orientation components of {001}<110>, {116}<110>, {114}<110> and {112}<110> on the plane at the center of the mother pipe wall thickness to the random X-ray intensity is 3 or smaller to a temperature in the range from 650 to 1,200° C. and by applying working under a condition of a diameter reduction ratio of 30% or more and a wall thickness reduction ratio of 5 to 30%.

28 Claims, No Drawings

STEEL PIPE HAVING HIGH FORMABILITY AND METHOD FOR PRODUCING THE SAME

TECHNICAL FIELD

This invention relates to a steel pipe, used, for example, for panels, undercarriage components and structural members of cars and the like, and a method of producing the same. The steel pipe is especially suitable for hydraulic forming (see Japanese Unexamined Patent Publication No. H10-175027).

The steel pipes according to the present invention include those without a surface treatment as well as those with a surface treatment for rust protection, such as hot dip galvanizing, electroplating or the like. The galvanizing includes plating with pure zinc and plating with an alloy containing zinc as the main component.

The steel pipe according to the present invention is very excellent especially for hydraulic forming wherein an axial compressing force is applied, and thus can improve the efficiency in manufacturing auto components when they are processed by hydraulic forming. The present invention is also applicable to high strength steel pipes and, therefore, it is possible to reduce the material thickness of the components, and encourages the global environmental conservation.

BACKGROUND ART

A higher strength of steel sheets has been desired as the need for weight reduction in cars has increased. The higher strength of steel sheets makes it possible to reduce car weight through the reduction of material thickness and to improve collision safety. Attempts have recently been made to manufacture components with complicated shapes from high strength steel pipes using hydraulic forming methods. These attempts aim at a reduction in the number of components or welded flanges, etc. in response to the need for weight and cost reductions.

The actual application of new forming technologies such as the hydraulic forming method is expected to produce great advantages such as cost reduction, the increased degree of freedom in design work and the like. In order to fully enjoy the advantages of hydraulic forming methods, new materials suitable for the new forming methods are required. The inventors of the present invention have already proposed a steel pipe excellent in formability, and having a controlled texture, in Japanese Patent Application No. 2000-52574.

DISCLOSURE OF THE INVENTION

As the issues of the global environment become more and more serious, it is considered that an increasing demand for steel pipes having higher strengths is inevitable when the hydraulic forming method is used. In that event, the formability of the higher strength materials will surely become a more serious problem than before.

Diameter reduction in the $\alpha+\gamma$ phase zone or the $\alpha$ phase zone is effective for obtaining a good r-value but, in commonly used steel materials, only a small decrease in the temperature of the diameter reduction results in the problem that a deformed structure remains and an n-value lowers.

The present invention provides a steel pipe having improved formability and a method to produce the same without incurring a cost increase.

The present invention provides a steel pipe, excellent in formability for hydraulic forming or the like, by clarifying the texture of a steel material excellent in formability, for hydraulic forming or the like, and a method to control the texture and by specifying the texture.

The gist of the present invention, therefore, is as follows:

(1) A steel pipe, excellent in formability, having a chemical composition comprising, in mass, 0.0001 to 0.50% of C, 0.001 to 2.5% of Si, 0.01 to 3.0% of Mn, 0.001 to 0.2% of P, 0.05% or less of S and 0.01% or less of N, with the balance consisting of Fe and unavoidable impurities, characterized by having: an r-value of 1.4 or larger in the axial direction of the steel pipe; and the property that the average of the ratios of the X-ray intensity in the orientation component group of {110}<110> to {332}<110> on the plane at the center of the steel pipe wall thickness to the random X-ray intensity is 3.5 or larger, and/or the ratio of the X-ray intensity in the orientation component of {110}<110> on the plane at the center of the steel pipe wall thickness to the random X-ray intensity is 5.0 or larger.

(2) A steel pipe, excellent in formability, according to the item (1) characterized by further containing 0.001 to 0.5 mass % of Al.

(3) A steel pipe, excellent in formability, having a chemical composition comprising, in mass, 0.0001 to 0.50% of C, 0.001 to 2.5% of Si, 0.01 to 3.0% of Mn, 0.001 to 0.2% of P, 0.05% or less of S, 0.01% or less of N, 0.01 to 2.5% of Al and 0.01% or less of O in a manner to satisfy the expressions (1) and (2) below, with the balance consisting of Fe and unavoidable impurities, characterized in that: the relationship between the tensile strength (TS) and the n-value of the steel pipe satisfies the expression (3) below; the volume percentage of its ferrite phase is 75% or more; the average grain size of the ferrite is 10 $\mu$m or more; and the crystal grains of the ferrite having an aspect ratio of 0.5 to 3.0 account for, in area percentage, 90% or more of all the crystal grains composing the ferrite.

$$(203\sqrt{C}+15.2Ni-44.7Si-104V-31.5Mo+30Mn+11Cr+20Cu-700P-200Al)<-20 \quad (1)$$

$$(44.7Si+700P+200Al)>80 \quad (2)$$

$$n \geqq -0.126\times\ln(TS)+0.94 \quad (3)$$

(4) A steel pipe, excellent in formability, according to the item (3), characterized by having: an r-value of 1.0 or larger in the longitudinal direction of the steel pipe; and the property that the average of the ratios of the X-ray intensity in the orientation component group of {110}<110> to {332}<110> to the random X-ray intensity is 2.0 or larger and the ratio of the X-ray intensity in the orientation component of {111}<112> to the random X-ray intensity is 1.5 or smaller on the plane at the center of the steel pipe wall thickness.

(5) A steel pipe, excellent in formability, having a chemical composition comprising, in mass, 0.0001 to 0.50% of C, 0.001 to 2.5% of Si, 0.01 to 3.0% of Mn, 0.001 to 0.2% of P, 0.05% or less of S, 0.01% or less of N, 0.2% or less of Ti and 0.15% or less of Nb in a manner to satisfy the expression $0.5 \leqq (Mn+13Ti+29Nb) \leqq 5$, with the balance consisting of Fe and unavoidable impurities, characterized by having the property that the ratio of the X-ray intensity in the orientation component of {111}<110> on the plane at the center of the steel pipe wall thickness to the random X-ray intensity is 5.0 or larger and the ratio of the X-ray intensity in the orientation component of {111}<112> on the plane at the center of the steel pipe wall thickness to the random X-ray intensity is below 2.0.

(6) A steel pipe, excellent in formability, according to the item (5) characterized by further containing 0.001 to 0.5 mass % of Al.

(7) A steel pipe, excellent in formability, according to the item (5) or (6), characterized in that every one of the r-values in the axial, circumferential and 45° directions is 1.4 or larger.

(8) A steel pipe, excellent in formability, according to any one of the items (1) to (7), characterized by further containing, in mass, 0.0001 to 2.5% in total of one or more of:

0.0001 to 0.5% of Zr, 0.0001 to 0.5% of Mg, 0.0001 to 0.5% of V, 0.0001 to 0.01% of B, 0.001 to 2.5% of Sn, 0.001 to 2.5% of Cr, 0.001 to 2.5% of Cu, 0.001 to 2.5% of Ni, 0.001 to 2.5% of Co, 0.001 to 2.5% of W, 0.001 to 2.5% of Mo, and 0.0001 to 0.01% of Ca.

(9) A steel pipe, excellent in formability, characterized in that the steel pipe according to any one of the items (1) to (8) is plated.

(10) A method to produce a steel pipe, excellent in formability, having a chemical composition comprising, in mass, 0.0001 to 0.50% of C, 0.001 to 2.5% of Si, 0.01 to 3.0% of Mn, 0.001 to 0.2% of P, 0.05% or less of S and 0.01% or less of N, with the balance consisting of Fe and unavoidable impurities, characterized by heating the steel pipe, having the property that the ratio of the X-ray intensity in every one of the orientation components of {001}<110>, {116}<110>, {114}<110> and {112}<110> on the plane at the center of the wall thickness of the mother pipe before diameter reduction to the random X-ray intensity is 3 or smaller, to a temperature in the range from 650° C. or higher to 1,200° C. or lower and by applying working under a condition of a diameter reduction ratio of 30% or more and a wall thickness reduction ratio of 5% or more to 30% or less, so that the steel pipe has an r-value of 1.4 or larger in the axial direction of the steel pipe and the property that the average of the ratios of the X-ray intensity in the orientation component group of {110}<110> to {332}<110> on the plane at the center of the steel pipe wall thickness to the random X-ray intensity is 3.5 or larger, and/or the ratio of the X-ray intensity in the orientation component of {110}<110> on the plane at the center of the steel pipe wall thickness to the random X-ray intensity is 5.0 or larger.

(11) A method to produce a steel pipe, excellent in formability, having a chemical composition comprising, in mass, 0.0001 to 0.50% of C, 0.001 to 2.5% of Si, 0.01 to 3.0% of Mn, 0.001 to 0.2% of P, 0.05% or less of S and 0.01% or less of N, with the balance consisting of Fe and unavoidable impurities, characterized by heating the steel pipe, having the property that the ratio of the X-ray intensity in one or more of the orientation components of {001}<110>, {116}<110>, {114}<110> and {112}<110> on the plane at the center of the wall thickness of the mother pipe before diameter reduction to the random X-ray intensity exceeds 3, to a temperature in the range from $(Ac_3-50)$° C. or higher to 1,200° C. or lower and by applying working under a condition of a diameter reduction ratio of 30% or more and a wall thickness reduction ratio of 5% or more to 30% or less, so that the steel pipe has an r-value of 1.4 or larger in the axial direction of the steel pipe and the property that the average of the ratios of the X-ray intensity in the orientation component group of {110}<110> to {332}<110> on the plane at the center of the steel pipe wall thickness to the random X-ray intensity is 3.5 or larger, and/or the ratio of the X-ray intensity in the orientation component of {110}<110> on the plane at the center of the steel pipe wall thickness to the random X-ray intensity is 5.0 or larger.

(12) A method to produce a steel pipe, excellent in formability, having a chemical composition comprising, in mass, 0.0001 to 0.50% of C, 0.001 to 2.5% of Si, 0.01 to 3.0% of Mn, 0.001 to 0.2% of P, 0.05% or less of S, 0.01% or less of N, 0.01 to 2.5% of Al and 0.01% or less of O in a manner to satisfy the expressions (1) and (2) below, with the balance consisting of Fe and unavoidable impurities, characterized by heating the mother pipe to 850° C. or higher at diameter reduction, applying the diameter reduction under a diameter reduction ratio of 20% or more in the temperature range from below the $Ar_3$ transformation temperature to 750° C. or higher and completing the diameter reduction at 750° C. or higher; so that the relationship between the tensile strength (TS) and the n-value of the steel pipe satisfies the expression (3) below, the volume percentage of its ferrite phase is 75% or more, the average grain size of the ferrite is 10 $\mu$m or more, and the crystal grains of the ferrite having an aspect ratio of 0.5 to 3.0 account for, in area percentage, 90% or more of all the crystal grains composing the ferrite.

$$(203\sqrt{C}+15.2Ni-44.7Si-104V-31.5Mo+30Mn+11Cr+20Cu-700P-200Al)<-20 \quad (1)$$

$$(44.7Si+700P+200Al)>80 \quad (2)$$

$$n \geqq -0.126\times\ln(TS)+0.94 \quad (3)$$

(13) A method to produce a steel pipe, excellent in formability, according to the item (12) characterized by applying diameter reduction so that the change ratio of the wall thickness of the steel pipe after the diameter reduction to that of the mother pipe is +5% to −30%.

(14) A method to produce a steel pipe, excellent in formability, having a chemical composition comprising, in mass, 0.0001 to 0.50% of C, 0.001 to 2.5% of Si, 0.01 to 3.0% of Mn, 0.001 to 0.2% of P, 0.05% or less of S, 0.01% or less of N, 0.2% or less of Ti and 0.15% or less of Nb in a manner to satisfy the expression $0.5 \leqq (Mn+13Ti+29Nb) \leqq 5$, with the balance consisting of Fe and unavoidable impurities, characterized by heating the mother pipe to a temperature of the $Ac_3$ transformation temperature or higher at diameter reduction, applying the diameter reduction under a diameter reduction ratio of 40% or more in the temperature range of the $Ar_3$ transformation temperature or higher, completing the diameter reduction at a temperature equal to or higher than the $Ar_3$ transformation temperature, commencing cooling within 5 sec. after completing the diameter reduction, and cooling the diameter-reduced steel pipe to a temperature of $(Ar_3-100)°$ C. or lower at a cooling rate of 5° C./sec. or more, so that the steel pipe has the property that the ratio of the X-ray intensity in the orientation component of {111}<110> on the plane at the center of the steel pipe wall thickness to the random X-ray intensity is 5.0 or larger and the ratio of the X-ray intensity in the orientation component of {111}<112> on the plane at the center of the steel pipe wall thickness to the random X-ray intensity is below 2.0.

(15) A method to produce a steel pipe, excellent in formability, having a chemical composition comprising, in mass, 0.0001 to 0.50% of C, 0.001 to 2.5% of Si, 0.01 to 3.0% of Mn, 0.001 to 0.2% of P, 0.05% or less of S, 0.01% or less of N, 0.2% or less of Ti and 0.15% or less of Nb in a manner to satisfy the expression $0.5 \leqq (Mn+13Ti+29Nb) \leqq 5$, with the balance consisting of Fe and unavoidable impurities, characterized by heating the mother pipe to a temperature of the $Ac_3$ transformation temperature or higher at diameter reduction, applying the diameter reduction under a diameter reduction ratio of 40% or more in the temperature range of the $Ar_3$ transformation temperature or higher, subsequently applying another step of the diameter reduction under a diameter reduction ratio of 10% or more in the temperature range from $Ar_3$ to $(Ar_3-100)°$ C., and completing the diameter reduction at a temperature in the range from $Ar_3$ to $(Ar_3-100)°$ C., so that the steel pipe has the property that the ratio of the X-ray intensity in the orientation component of {111}<110> on the plane at the center of the steel pipe wall thickness to the random X-ray intensity is 5.0 or larger and the ratio of the X-ray intensity in the orientation component of {111}<112> on the plane at the center of the steel pipe wall thickness to the random X-ray intensity is below 2.0.

(16) A method to produce a steel pipe, excellent in formability, according to any one of the items (10), (11), (14) and (15), characterized in that the steel pipe further contains 0.001 to 0.5 mass % of Al.

(17) A method to produce a steel pipe, excellent in formability, according to any one of the items (10) to (16), characterized in that the steel pipe further contains, in mass, 0.0001 to 2.5% in total of one or more of:

0.0001 to 0.5% of Zr, 0.0001 to 0.5% of Mg, 0.0001 to 0.5% of V, 0.0001 to 0.01% of B, 0.001 to 2.5% of Sn, 0.001 to 2.5% of Cr, 0.001 to 2.5% of Cu, 0.001 to 2.5% of Ni, 0.001 to 2.5% of Co, 0.001 to 2.5% of W, 0.001 to 2.5% of Mo, and 0.0001 to 0.01% of Ca.

BEST MODE FOR CARRYING OUT THE INVENTION

The present invention is explained hereafter in detail.

The chemical composition of a steel pipe according to the present invention is explained in the first place. The contents of elements are in mass percentage.

C is effective for increasing steel strength and, hence, 0.0001% or more of C has to be added but, since an excessive addition of C is undesirable for controlling steel texture, the upper limit of its addition is set at 0.50%. A content range of C from 0.001 to 0.3% is more preferable, and a content rage from 0.002 to 0.2% is better still.

Si raises mechanical strength at a low cost and may be added in an appropriate quantity in accordance with a required strength level. An excessive addition of Si, however, not only results in the deterioration of wettability in plating work and formability but also hinders the formation of good texture. For this reason, the upper limit of the Si content is set at 2.5%. Its lower limit is set at 0.001% since it is industrially difficult, using the current steelmaking technology, to lower the Si content below the figure.

Mn is effective for increasing steel strength and thus the lower limit of its content is set at 0.01%. It is preferable to add Mn so that $Mn/S \geqq 15$ is satisfied for the purpose of preventing hot cracking caused by S. The upper limit of the Mn content is set at 3.0% since its excessive addition lowers ductility. Note that the Mn content range from 0.05 to 0.50% is more preferable for the items (3) and (4) of the present invention.

P is an important element like Si. It has the effects to raise the $\gamma$ to $\alpha$ transformation temperature and expand the $\alpha+\gamma$ dual phase temperature range. P is effective also for increasing steel strength. Hence, P may be added in consideration of a required strength level and the balance with the Si and Al contents. The upper limit of the P content is set at 0.2% since its addition in excess of 0.2% causes defects during hot rolling and diameter reduction and deteriorates formability. Its lower limit is set at 0.001% to prevent steelmaking costs from increasing. A content range of P from 0.02 to 0.12% is more preferable for the items (3) and (4) of the present invention.

S is an impurity element and the lower its content, the better. Its content has to be 0.03% or less, more preferably 0.015% or less, to prevent hot cracking.

N is also an impurity element, and the lower its content, the better. Its upper limit is set at 0.01% since N deteriorates formability. A more preferable content range is 0.005% or less.

Al is effective for deoxidation. However, an excessive addition of Al causes oxides and nitrides to crystallize and precipitate in great quantities and deteriorates the plating property as well as the ductility. The addition amount of Al, therefore, has to be 0.001 to 0.50%. Note that Al is an important element, like Si and P, for the items (3) and (4) of the present invention because it has an effect to raise the γ to α transformation temperature and expand the α+γ dual phase temperature range. Besides, since Al scarcely changes the mechanical strength of steel, it is an element effective to obtain a steel pipe having comparatively low strength and excellent formability. Al may be added in consideration of a required strength level and the balance with the Si and P contents. An addition of Al in excess of 2.5%, however, causes the deterioration of wettability in plating work and remarkably hinders the progress of alloy formation reactions and, hence, its upper limit is set at 2.5%. At least 0.01% of Al is necessary for the deoxidation of steel and thus its lower limit is set at 0.01%. A more preferable content range of Al is from 0.1 to 1.5%.

O deteriorates the formability of steel when it is included excessively and, for this reason, its upper limit is set at 0.01%.

When a steel pipe contains Al and O like in the items (3) and (4) of the present invention, the expressions (1) and (2) below are significant: the expression (1) is determined for the purpose of raising the γ to α transformation temperature of the steel pipe beyond that of pure iron; and the expression (2) means active use of Si, P and Al for raising the γ to α transformation temperature. A very excellent formability is obtained only when both of the expressions are satisfied.

$$(203\sqrt{C}+15.2Ni-44.7Si-104V-31.5Mo+30Mn+11Cr+20Cu-700P-200Al)<-20 \quad (1)$$

$$(44.7Si+700P+200Al)>80 \quad (2)$$

The following expressions (1') and (2') are more preferable for raising the γ to α transformation temperature and realizing still more excellent formability:

$$(203\sqrt{C}+15.2Ni-44.7Si-104V-31.5Mo+30Mn+11Cr+20Cu-700P-200Al)<-50 \quad (1')$$

$$(44.7Si+700P+200Al)>110 \quad (2')$$

In addition to the chemical composition of a steel pipe according to the present invention satisfying the expressions (1) and (2), the n-value and tensile strength TS (MPa) of a steel pipe according to the present invention have to satisfy the expression (3) below:

$$n \geqq -0.126\times\ln(TS)+0.94 \quad (3)$$

This means that, since the n-value, which is an indicator of formability, changes depending on TS, it has to be specified in relation to the value of TS. A steel pipe having a value of Ts of 350 MPa, for example, has to have an n-value of about 0.20 or more. More preferably, the above expression is as follows:

$$n \geqq -0.126\times\ln(TS)+0.96.$$

The value of Ts and the n-value are measured through tensile tests using No. 11 tubular form test pieces or No. 12 arc section test pieces under Japanese Industrial Standard (JIS). The n-value may be evaluated in terms of 5 and 15% strain but, when uniform elongation is below 15%, it is evaluated in terms of 5 and 10% strain and, when uniform elongation does not reach 10%, in terms of 3 and 5% strain.

Mn, Ti and Nb are important especially for the items (5) and (6) of the present invention. Since these elements improve texture by restraining the recrystallization of the γ phase and favorably affecting the variant selection during transformation when the diameter reduction is carried out in the γ phase zone, one or more of them are added up to the respective upper limits of 3.0, 0.2 and 0.15%.

If they are added in excess of the respective upper limits, no further effect to improve the texture is obtained and, adversely, ductility may be deteriorated.

Further, for the items (5) and (6) of the present invention, Mn, Ti and Nb have to be added so that the expression $0.5 \leqq (Mn+13Ti+29Nb) \leqq 5$ is satisfied. When the value of Mn+13Ti+29Nb is below 0.5, the effect of the texture improvement is not enough. If these elements are added so as to make the value of Mn+13Ti+29Nb exceed 5, in contrast, the effect of the texture improvement does not increase any more but the steel pipe is remarkably hardened and its ductility is deteriorated. For this reason, the upper limit of the value of Mn+13Ti+29Nb is set at 5. A range from 1 to 4 is more preferable.

Zr and Mg are effective as deoxidizing agents. Their excessive addition, however, causes the crystallization and precipitation of oxides, sulfides and nitrides in great quantities, resulting in the deterioration of steel cleanliness, and this lowers ductility and plating property. For this reason, one or both of the elements should be added, as required, to 0.0001 to 0.50% in total.

V, when added to 0.001% or more, increases steel strength and formability through the formation of carbides, nitrides or carbo-nitrides but, when its content exceeds 0.5%, V precipitates in great quantities in the grains of the matrix ferrite or at the grain boundaries in the form of the carbides, nitrides or carbo-nitrides to deteriorate ductility. The addition range of V, therefore, is defined as 0.001 to 0.5%.

B is added as required. B is effective to strengthen grain boundaries and increase steel strength. When its content exceeds 0.01%, however, the above effect is saturated and, adversely, steel strength is increased more than necessary and formability is deteriorated. The content of 3 is limited, therefore, to 0.0001 to 0.01%.

Ni, Cr, Cu, Co, Mo, W and Sn are steel hardening elements and thus one or more of them have to be added, as required, by 0.001% or more in total. Since an excessive addition of these elements increases production costs and lowers steel ductility, the upper limit of their addition is set at 2.5% in total.

Ca is effective for deoxidation and the control of inclusions and, hence, its addition in an appropriate amount increases hot formability. Its excessive addition, however, causes hot shortness, and thus the range of its addition is defined as 0.0001 to 0.01%, as required.

The effects of the present invention are not hindered even when 0.01% or less each of Zn, Pb, As, Sb, etc. are included in a steel pipe as unavoidable impurities.

It is preferable that a steel pipe contains one or more of Zr, Mg, V, B, Sn, Cr, Cu, Ni, Co, W, Mo, Ca, etc., as required, to 0.0001% or more and 2.5% or less in total.

When producing a steel pipe specified in the items (1), (2), (10) and (11) of the present invention, the ratios of the X-ray intensity in the orientation component group of {110}<110> to {332}<110> and the orientation components of {110}<110> on the plane at the center of the steel pipe wall thickness to the random X-ray intensity, in addition to the steel chemical composition, are the most important property figures for applying the hydraulic forming or the like to the steel pipe.

The present invention stipulates that, in the X-ray diffraction measurement on the plane at the wall thickness center to determine the ratios of the X-ray intensity in different orientation components to that of a random specimen, the average of the ratios in the orientation component group of {110}<110> to {332}<110> is 3.5 or larger. The main orientation components included in the orientation component group are {110}<110>, {661}<110>, {441}<110>, {331}<110>, {221}<110> and {332}<110>.

There are cases that the orientations of {443}<110>, {554}<110> and {111}<110> also develop in an above-specified steel pipe according to the present invention. These orientations are good for hydraulic forming but, since they are the orientations commonly observed in a cold rolled steel sheet for deep drawing use, they are intentionally excluded from the present invention for distinctiveness. This means that an above-specified steel pipe according to the present invention has a crystal orientation group not obtainable through simply forming a cold rolled steel sheet for deep drawing use into a pipe by electric resistance welding or the like.

Further, an above-specified steel pipe according to the present invention scarcely has the crystal orientations of {111}<112> and {554}<225>, which are typical crystal orientations of cold rolled steel sheets having high r-values, and the ratio of the X-ray intensity in each of these orientation components to the random X-ray intensity is 2.0 or less and, more preferably, below 1.0. The ratios of the X-ray intensity in these orientations to the random X-ray intensity can be obtained from the three-dimensional texture calculated by the harmonic series expansion method based on three or more pole figures of {110}, {100}, {211} and {310}. In other words, the ratio of the X-ray intensity in each of the crystal orientations to the random X-ray intensity can be represented by the intensity of (110)[1–10], (661)[1–10], (441)[1–10], (331)[1–101], (221)[1–10] and (332)[1–10] at a $\phi 2=45°$ cross section in the three-dimensional texture.

Note that the texture of an above-specified steel pipe according to the present invention usually has the highest intensity in the range of the above orientation component group at the $\phi 2=45°$ cross section, and the farther away it is from the orientation component group, the lower the intensity level gradually becomes. Considering the factors such as the X-ray measurement accuracy, axial twist during the pipe production, and the accuracy in the X-ray sample preparation, however, there may be cases that the orientation in which the X-ray intensity is the largest deviates from the above orientation component group by about ±5° to ±10°.

The average of the ratios of the X-ray intensity in the orientation component group of {110}<110> to {332}<110> to the random X-ray intensity means the arithmetic average of the ratios of the X-ray intensity in the above orientation components to the random X-ray intensity. When the X-ray intensity of all the above orientation components cannot be obtained, the arithmetic average of those in the orientation components of {110}<110>, {441}<110> and {221}<110> may be used as a substitute. Among these orientation components, {110}<110> is of especial importance and it is preferable that the ratios of the X-ray intensity in the orientation components of {110}<110> to the random X-ray intensity are 5.0 or larger.

It goes without saying that it is better yet, especially for a steel pipe for hydraulic forming use, to have 3.5 or larger as an average of the ratios of the X-ray intensity in the orientation component group of {110}<110> to {332}<110> to the random X-ray intensity and 5.0 or larger as the X-ray intensity ratio in the orientation component of {110}<110> to the random X-ray intensity. Further, when forming is difficult, it is preferable that the average of the ratios of the X-ray intensity in the above orientation component group to the random X-ray intensity is 5.0 or larger and/or the ratio of the X-ray intensity in the orientation component of {110}<110> to the random X-ray intensity is 7.0 or larger.

The X-ray intensity in other orientation components such as {001}<110>, {116}<110>, {114}<110>, {113}<110>, {112}<110> and {223}<110> is not specified in the present invention since it fluctuates depending on production conditions, but it is preferable that the average of the ratios in these orientation components is 3.0 or smaller.

The above characteristics of the texture according to the present invention cannot be expressed with the commonly used inverse pole figure and conventional pole figure only, but it is preferable that the ratios of the X-ray intensity in the above orientation components to the random X-ray intensity are as specified below when, for example, inverse pole figures expressing the orientations in the radial direction of a steel pipe are measured near the wall thickness center:

2 or smaller in <100>, 2 or smaller in <411>, 4 or smaller in <211>, 15 or smaller in <111>, 15 or smaller in <332>, 20.0 or smaller in <221>, and 30.0 or smaller in <110>.

In addition, in inverse pole figures expressing the orientations in the axial direction of a steel pipe: 10 or larger in <110>, and 3 or smaller in all the 1s orientation components other than <110>.

While the r-value of an above-specified steel pipe according to the present invention varies depending on the change of the texture, at least the axial r-value has a value of 1.4 or larger. It may become even larger than 3.0 under some production conditions. The present invention does not specify the anisotropy of the r-value.

In other words, the axial r-value may be either smaller or larger than those in the circumferential and radial directions. The axial r-value often becomes 1.4 or larger inevitably when, for example, a cold rolled steel sheet having a high r-value is simply formed into a steel pipe by electric resistance welding. An above-specified steel pipe according to the present invention, however, is clearly distinguished from such a steel pipe for the reasons that it has the texture described hereinbefore and its r-value is 1.4 or larger.

The r-value may be evaluated using JIS No. 11 tubular form test pieces or JIS No. 12 arc section test pieces. The amount of strain is evaluated in the test at an elongation of 15% and, if uniform elongation is below 15%, an amount of strain within the range of the uniform elongation is used. Note that it is preferable to cut out the test pieces from pipe portions other than the seam portion.

Next, when producing a steel pipe specified in the items (5), (6), (7), (14) and (15) of the present invention, the ratios of the X-ray intensity in the orientation components of {111}<110> and {111}<112> on the plane at the center of the steel pipe wall thickness to the random X-ray intensity, in addition to the steel chemical composition, are important property figures for the purpose of the present invention.

It is necessary that, in the X-ray diffraction measurement on the plane at the wall thickness center to determine the ratios of the X-ray intensity in different orientation components to that of a random specimen, the ratio in the orientation component of {111}<110> is 5.0 or larger and the same in the orientation component of {111}<112> is below 2.0.

Although the orientations of {111}<112> are good for hydraulic forming, since the orientations are the typical crystal orientations of a common cold rolled steel sheet having a high r-value, the ratio in the orientation component is intentionally specified herein as below 2.0 for the purpose of distinguishing a steel pipe of the present invention from the cold rolled steel sheet. Further, in the texture obtained through box annealing of a low carbon cold rolled steel sheet, the {111}<110> orientations are the main orientations and the {111}<112> orientations are the minor orientations and this is similar to the characteristics of the texture according to the present invention. Also, in the case of the box-annealed cold rolled steel sheet, the ratio of the X-ray intensity in the orientation component of {111}<112> to the random X-ray intensity becomes 2.0 or larger, and, for this reason, it has to be clearly distinguished from an above-specified steel pipe according to the present invention.

It is more preferable if the ratio of the X-ray intensity in the orientation component of {111}<110> to the random X-ray intensity is 7.0 or larger and the same in the orientation components of {111}<112> is below 1.0.

The {554}<225> orientation is, like the {111}<112> orientations, also the main orientation of a high r-value cold rolled steel sheet, but these orientations are scarcely seen in an above-specified steel pipe according to the present invention. It is therefore preferable that the ratio of the X-ray intensity in the orientation component of {554}<225> of a steel pipe according to the present invention to the random X-ray intensity is below 2.0 and, more preferably, below 1.0. The ratios of the X-ray intensity in these orientations to the random X-ray intensity can be obtained from the three-dimensional texture calculated by the harmonic series expansion method based on three or more pole figures of {110}, {100}, {211} and {310}.

In other words, the ratio of the X-ray intensity in each of the crystal orientations to the random X-ray intensity can be represented by the intensity of (111)[1–10], (111)[1–21] and (554)[–2–25] at a $\phi 2=45°$ cross section in the three-dimensional texture.

Note that the texture of an above-specified steel pipe according to the present invention usually has the highest intensity in the orientation component of (111)[1–10] at the $\phi 2=45°$ cross section, and the farther away it is from this orientation component group, the lower the X-ray intensity level gradually becomes. Considering the factors such as the X-ray measurement accuracy, axial twist during the pipe production, and the accuracy in the X-ray sample preparation, however, there may be cases that the orientation, in which the X-ray intensity is the largest, deviates from the above orientation component group by about ±5°.

Further, the present invention does not specify the ratio of the X-ray intensity in the orientation component of {001}<110> to the random X-ray intensity, but it is preferable that the value is 2.0 or smaller since this orientation lowers the axial r-value. A more preferable value of the ratio is 1.0 or less. The ratios of the X-ray intensity in the other orientation components such as {116}<110>, {114}<110> and {113}<110> to the random X-ray intensity are not specified in the present invention either, but it is preferable that the ratios in these orientations are 2.0 or smaller since these orientations also lower the axial r-value.

The ratios of the X-ray intensity in the orientation components of {001}<110>, {116}<110>, {114}<110> and {113}<110> to the random X-ray intensity may be represented by the same of (001)[1–10], (116)[1–10], (114)[1–10] and (113)[1–10] at the $\phi 2=45°$ cross section in the three-dimensional texture.

The above characteristics of the texture according to the present invention cannot be expressed with the commonly used inverse pole figure and conventional pole figure only, but it is preferable that the ratios of the X-ray intensity in the above orientation components to the random X-ray intensity are as specified below when, for example, inverse pole figures expressing the orientations in the radial direction of a steel pipe are measured near the wall thickness center:

1.5 or smaller in <100>, 1.5 or smaller in <411>, 3 or smaller in <211>, 6 or larger in <111>, 10 or smaller in <332>, 7 or smaller in <221> and 5 or smaller in <110>.

In addition, in inverse pole figures expressing the orientations in the axial direction of a steel pipe: 15 or larger in <110>, and 3 or smaller in all the orientation components other than <110>.

All the r-values in the axial and circumferential directions and 45° direction, which is just in the middle of the axial and circumferential directions, of an above-specified steel pipe according to the present invention become 1.4 or larger. The axial r-value may exceed 2.5. The present invention does not specify the anisotropy of the r-value, but, in an above-specified steel pipe according to the present invention, the axial r-value is a little larger than the r-values in the circumferential and 45° directions, though the difference is 1.0 or less. Note that, when a cold rolled steel sheet having a high r-value, for example, is simply formed into a steel pipe by electric resistance welding, the axial r-value may become 1.4 or larger depending on the cutting plan of the steel sheet. However, an above-specified steel pipe according to the present invention is clearly distinguished from such a steel pipe in that the former has the texture described hereinbefore.

Further next, when producing a steel pipe specified in the items (3), (4), (12) and (13) of the present invention, the structure of steel, in addition to its chemical composition, has to be controlled.

The structure of an above-specified steel pipe according to the present invention comprises ferrite accounting for 75% or more. This is because, when the percentage of ferrite is below 75%, good formability cannot be maintained. A ferrite percentage of 85% or more is preferable and, if it is 90% or more, better still. The effect of the present invention is obtained even when the volume percentage of the ferrite phase is 100%, but it is preferable to have a secondary phase appropriately dispersed in the ferrite phase especially when it is necessary to increase steel strength. The secondary phase other than the ferrite phase is composed of one or more of pearlite, cementite, austenite, bainite, acicular ferrite, martensite, carbo-nitrides and intermetallic compounds.

The average crystal grain size of the ferrite is 10 $\mu$m or larger. When it is less than 10 $\mu$m, it becomes difficult to secure good ductility. A preferable average crystal grain size of the ferrite is 20 $\mu$m or larger and, yet more preferably, 30 $\mu$m or larger. No specific upper limit is set for the average crystal grain size of the ferrite but, when it is extravagantly large, ductility is lowered and the pipe surface becomes coarse. For this reason, it is preferable that the average crystal grain size of the ferrite is 200 $\mu$m or less.

The average grain size of the ferrite may be determined by the point counting method or the like by mirror-polishing the section (L section) along the rolling direction and perpendicular to the surface of the pipe material steel sheet, etching the polished surface with a suitable etching reagent and then observing an area of 2 $mm^2$ or larger selected at random in the range from ⅛ to ⅞ of its thickness.

Additionally, the crystal grains having an aspect ratio of 0.5 to 3.0 have to account for 90% or more of the ferrite. Since the structure of an above-specified steel pipe according to the present invention is finally formed through recrystallization, the size of the ferrite crystal grains is regulated and most of the crystal grains will have the above aspect ratio. It is preferable that the percentage of the specified grains is 95% or more and, yet more preferably, 98% or more. The effect of the present invention is naturally obtained even if the above percentage is 100. A more preferable range of the aspect ratio is from 0.7 to 2.0.

Note that the aspect ratio is defined as the quotient (X/Y) of the maximum length (X) in the rolling direction of a crystal grain divided by the maximum length (Y) in the thickness direction of the crystal grain at a section (L section) along the rolling direction and perpendicular to the surface of a steel sheet. The volume percentage of the crystal grains having the above range of aspect ratio is represented by the area percentage of the same, and the area percentage may be determined by the point counting method or the like by etching the L section surface with a suitable etching reagent and then observing an area of 2 $mm^2$ or larger selected at random in the range from ⅛ to ⅞ of the sheet thickness.

While the r-value of an above-specified steel pipe according to the present invention varies depending on the change of the texture, it is preferable that the axial r-value of a steel pipe is 1.0 or larger. It is more preferable if the r-value is 1.5 or larger. The axial r-value may exceed 2.5 under a certain production conditions. The present invention does not specify the anisotropy of the r-value. In other words, the axial r-value may be either smaller or larger than those in the circumferential and radial directions.

The axial r-value often becomes 1.0 or larger inevitably when, for example, a cold rolled steel sheet having a high r-value is simply formed into a steel pipe by electric resistance welding. A steel pipe according to the item (4) of the present invention, however, is clearly distinguished from such a steel pipe for the reasons that it has the texture described hereafter and, at the same time, its r-value is 1.0 or larger.

The averages of the ratios of the X-ray intensity in the orientation component group of {110}<110> to {332}<110> and the X-ray intensity in the orientation component of {111}<112> on the plane at the center of the steel plate wall thickness to the random X-ray intensity are important property figures for the hydraulic forming. The present invention stipulates that, in the X-ray diffraction measurement on the plane at the wall thickness center to determine the ratios of the X-ray intensity in different orientation components to that of a random specimen, the average of the ratios of the X-ray intensity in the orientation component group of {110}<110> to {332}<110> to the random X-ray intensity is 2.0 or larger. The main orientation components included in the orientation component group are {110}<110>, {661}<110>, {441}<110>, {331}<110>, {221}<110> and {332}<110>.

There are cases that the orientations of {443}<110>, {554}<110> and {111}<110> also develop in an above-specified steel pipe according to the present invention. These orientations are good for hydraulic forming but, since they are the orientations commonly observed also in a cold rolled steel sheet for deep drawing use, they are intentionally excluded from the present invention for distinctiveness.

This means that a steel pipe according to the present invention has a crystal orientation group not obtainable through simply forming a cold rolled steel sheet for deep drawing use into a pipe by electric resistance welding or the like.

Further, an above-specified steel pipe according to the present invention scarcely has the crystal orientation of {111}<112>, which are typical crystal orientation of a cold rolled steel sheet having a high r-value, and the ratio of the X-ray intensity in each of these orientation components to the random X-ray intensity is 1.5 or less and, more preferably, below 1.0. The ratios of the X-ray intensity in these orientations to the random X-ray intensity can be obtained from the three-dimensional texture calculated by the harmonic series expansion method based on three or more pole figures of {110}, {100}, {211} and {310}. In other words, the ratio of the X-ray intensity in each of the crystal orientations to the random X-ray intensity is represented by the intensity of (110)[1–10], (661)[1–10], (441)[1–10], (331)[1–10], (221)[1–10] and (332)[1–10] at a $\phi 2=45°$ cross section in the three-dimensional texture.

Note that the texture of an above-specified steel pipe according to the present invention usually has the highest intensity in the range of the above orientation component group at the $\phi 2=45°$ cross section, and the farther away it is from the orientation component group, the lower the intensity level gradually becomes. Considering the factors such as the X-ray measurement accuracy, axial twist during the pipe production, and the accuracy in the X-ray sample preparation, however, there may be cases that the orientation in which the X-ray intensity is the largest deviates from the above orientation component group by about ±5° to ±10°.

The average of the ratios of the X-ray intensity in the orientation component group of {110}<110> to {332}<110> to the random X-ray intensity means the arithmetic average of the ratios of the X-ray intensity in the above orientation components to the random X-ray intensity. When the X-ray intensity of all the above orientation components cannot be obtained, the arithmetic average of those in the orientation components of {110}<110>, {441}<110> and {221}<110> may be used as a substitute. It goes without saying that it is better yet, especially for a steel pipe for hydraulic forming use, to have 3.0 or larger as an average of the ratios of the X-ray intensity in the orientation component group of {110}<110> to {332}<110> to the random X-ray intensity.

Further, when forming is difficult, it is preferable that the average of the ratios, of the X-ray intensity in the above orientation component group to the random X-ray intensity, is 4.0 or larger. The X-ray intensity in other orientation components such as {001}<110>, {116}<110>, {114}<110>, {113}<110>, {112}<110> and {223}<110> is not specified in the present invention since it fluctuates depending on production conditions, but it is preferable that the average of the ratios in these orientation components is 3.0 or smaller.

For the X-ray diffraction measurements of any of the steel pipes specified in the present invention, arc section test pieces are cut out from the steel pipes and pressed into flat pieces. Further, when pressing the arc section test pieces into the flat pieces, it is preferable to do that under as low strain as possible for avoiding the influence of crystal rotation caused by the working.

Then, the flat test pieces thus prepared are ground to near the thickness center by a mechanical, chemical or other polishing method, the ground surface is mirror-polished by buffing, and then strain is removed by electrolytic or chemical polishing so that the thickness center layer is exposed for the X-ray diffraction measurement.

When a segregation band is found in the wall thickness center layer, the measurement may be conducted at an area free from the segregation anywhere in the range from ⅜ to ⅝ of the wall thickness. Further, when the X-ray diffraction measurement is difficult, the EBSP method or ECP method may be employed to secure a statistically sufficient number of measurements.

Although the texture of the present invention is specified by the result of the X-ray measurement on the plane at the wall thickness center or near it as stated above, it is preferable that a steel pipe has a similar texture across the wall thickness range other than around the wall thickness center.

In the present invention, there may be cases that the texture in the range from the outer surface to ¼ or so of the wall thickness does not satisfy the requirements described above since the texture changes owing to shear deformation as a result of the diameter reduction described hereafter. Note that {hkl}<uvw> means that, when the test pieces for the X-ray diffraction measurement are prepared in the manner described above, the crystal orientation perpendicular to the plane surface is <hkl> and the crystal orientation along the longitudinal direction of the steel pipe is <uvw>.

The characteristics of the texture according to the present invention cannot be expressed with the commonly used inverse pole figure and conventional pole figure only, but it is preferable that the ratios of the X-ray intensity in the above orientation components to the random X-ray intensity are as specified below when, for example, inverse pole figures expressing the orientations in the radial direction of a steel pipe are measured near the wall thickness center:

2 or smaller in <100>, 2 or smaller in <411>, 4 or smaller in <211>, 8 or smaller in <111>, 10 or smaller in <332>, 15.0 or smaller in <221>, and 20.0 or smaller in <110>.

In addition, in inverse pole figures expressing the orientations in the axial direction of a steel pipe: 8 or larger in <110>, and 3 or smaller in all the orientation components other than <110>.

The method to produce a steel pipe according to the present invention is explained hereafter.

Steel is melted through a blast furnace process or an electric arc furnace process and is, then, subjected to various secondary refining processes and cast by ingot casting or continuous casting. In the case of the continuous casting, a production method such as the CC-DR process to hot roll a cast slab without cooling it to near the room temperature may be employed in combination.

The cast ingots or the cast slabs may, of course, be reheated before hot rolling. The present invention does not specify a reheating temperature of hot rolling, and any reheating temperature to realize a target finish rolling temperature is acceptable.

The finishing temperature of hot rolling may be within any of the temperature ranges of the normal γ single phase zone, α+γ dual phase zone, α single phase zone, α+pearlite zone, or α+cementite zone. Roll lubrication may be applied at one or more of the hot rolling passes. It is also permitted to join rough-rolled bars after rough hot rolling and apply finish hot rolling continuously. The rough-rolled bars after rough hot rolling may be wound into coils and then unwound for finish hot rolling.

The present invention does not specify a cooling rate and a coiling temperature after hot rolling. It is preferable to pickle a strip after hot rolling. Further, a hot-rolled steel strip may undergo skin pass rolling or cold rolling of a reduction ratio of 50% or less.

For forming a rolled strip into a pipe, electric resistance welding is usually employed, but other welding/pipe forming methods such as TIG welding, MIG welding, laser welding, a U0 press method, butt welding and the like may also be employed. In the above welded pipe production, heat affected zones of the welded seams may be subjected to one or more local solution heat treatment processes, singly or in combination and in multiple stages depending on the case, in accordance with required material property. This will help enhance the effect of the present invention. The heat treatment is meant to apply only to the welded seams and heat affected zones of the welding, and may be conducted on-line, during the pipe forming, or off-line.

The heating temperature prior to the diameter reduction work is important in the items (10) and (11) of the present invention. The heating temperature is within the range from 650° C. or higher to 1,200° C. or lower when the ratio of the X-ray intensity in all of the {111}<110>, {116}<110>, {114}<110> and {112}<110> orientation components on the plane at the thickness center of a hot rolled steel sheet or a mother pipe before heating and diameter reduction to the random X-ray intensity are 3 or smaller. When the heating temperature is below 650° C., the diameter reduction becomes difficult. Additionally, the structure of the steel pipe after the diameter reduction becomes deformed structure and it becomes necessary to heat the steel pipe again to maintain formability, which increases production costs.

With a heating temperature over 1,200° C., an excessive amount of scale forms on a pipe surface, deteriorating not only its surface quality but also its formability. A more preferable upper limit of the heating temperature is 1,050° C. The texture of a mother pipe is changed as described above when, for example, the hot finish rolling temperature is within the recrystallization temperature range and not below the $Ar_3$ transformation temperature or a material strip is slow cooled after hot rolling.

On the other hand, when the ratio of the X-ray intensity in one or more of the {001}<110>, {116}<110>, {114}<110> and {112}<110> orientation components of a mother pipe before diameter reduction to the random X-ray intensity are over 3, its heating temperature has to be in the range from $(Ac_3-50)$° C. to 1,200° C. A mother pipe having the structure described above cannot yield a texture suitable for hydraulic forming unless the heating temperature prior to diameter reduction is $(Ac_3-50)$° C. or higher, even if the diameter reduction is properly conducted thereafter. In other words, the envisaged texture is obtained only when the texture of a mother pipe is weakened by heating once to a high temperature of the α+γ dual phase zone or the γ single phase zone and diameter reduction is applied immediately thereafter. It is more preferable if the heating temperature is the $Ac_3$ transformation temperature or higher.

If the heating temperature exceeds 1,200° C., the above effect becomes saturated and, instead, the scale problem occurs. The upper limit of the heating temperature, therefore, is set at 1,200° C. A more preferable upper limit is 1,050° C. In this case, a mother pipe may be cooled once after the heating and then reheated to the temperature range of diameter reduction. The texture of the mother pipe becomes as described above when, for example, the hot finish rolling temperature is just above the $Ar_3$ transformation temperature where the recrystallization has not commenced, or below the $Ar_3$ transformation temperature, or the material strip is rapidly cooled after hot rolling. Note that when a hot rolled strip is judged to have the same texture as a mother pipe, the texture of the hot rolled strip may be used as a substitute of the texture of the mother pipe. The ratios of the X-ray intensity in the orientation components of {001}<110>, {116}<110>, {114}<110> and {112}<110> to the random X-ray intensity may be represented by the same of (001)[1–10], (116)[1–10], (114)[1–10] and (114)[1–10] at a $\phi 2=45°$ cross section in the three-dimensional texture.

The manner of diameter reduction is also of importance: the diameter reduction ratio has to be 30% or more, and the wall thickness reduction ratio 5% or more and below 30%. With a diameter reduction ratio below 30%, a good texture does not develop sufficiently. A preferable diameter reduction ratio is 50% or more. The effects of the present invention can be obtained without specifically setting an upper limit of the diameter reduction ratio, but a diameter reduction ratio of 90% or less is preferable from the productivity viewpoint. It is not enough to simply apply a diameter reduction ratio of 30% or more, but it is necessary to reduce the diameter and to reduce the wall thickness at the same time. It is difficult to obtain a good texture if the wall thickness increases or does not change. The wall thickness reduction ratio, therefore, has to be 5 to 30% and, more preferably, 10 to 25%.

Note that the diameter reduction ratio is defined as {(mother pipe diameter before diameter reduction–steel pipe diameter after diameter reduction)/mother pipe diameter before diameter reduction}×100(%), and the wall thickness reduction ratio as {(mother pipe wall thickness before diameter reduction–steel pipe wall thickness after diameter reduction)/mother pipe wall thickness before diameter reduction}×100(%). Here, the diameter of a steel pipe is its outer diameter.

It is preferable that the diameter reduction is finished at a temperature in any one of the $\alpha+\gamma$ phase zone, $\alpha$ single phase zone, $\alpha$+cementite zone, and $\alpha$+pearlite zone, because it is necessary for obtaining a good texture that a certain amount or more of the diameter reduction is imposed on the a phase.

Next, the requirements specified in the items (14) and (15) of the present invention are explained hereafter.

The heating temperature prior to the diameter reduction and the conditions of the diameter reduction subsequent to the heating are of significant importance in the above items of the present invention. The present invention according to the items (14) and (15) is based on the following new finding: the present inventors discovered that the texture near the {111}<110> orientations, which are good for hydraulic forming, remarkably developed when a $\gamma$ phase texture was developed, in the first step, by holding the $\gamma$ phase in a state before recrystallization or controlling its recrystallization percentage to 50% or less through a diameter reduction in the $\gamma$ phase zone, and then the $\gamma$ phase texture thus formed was transformed.

The heating temperature has to be equal to or higher than the $Ac_3$ transformation temperature. This is because the $\gamma$ phase texture before recrystallization develops when heavy diameter reduction is applied in the $\gamma$ single phase zone.

No upper limit is set specifically for the heating temperature but, for maintaining a good surface property, it is preferable that the heating temperature is 1,150° C. or lower. A temperature range from $(Ac_3+100)$° C. to 1,100° C. is more preferable.

The diameter reduction in the $\gamma$ phase zone has to be conducted so that the diameter reduction ratio is 40% or larger. When the ratio is below 40%, the texture before recrystallization does not develop in the $\gamma$ phase zone and it becomes difficult to finally obtain a desirable r-value and texture. It is preferable that the diameter reduction ratio is 50% or more and, if it is 65% or more, better still. It is desired that the diameter reduction in the $\gamma$ phase zone is completed at a temperature as close to the $Ar_3$ transformation temperature as possible.

Note that the diameter reduction ratio is defined in this case as {(mother pipe diameter before diameter reduction—steel pipe diameter after diameter reduction in $\gamma$ phase zone)/mother pipe diameter before diameter reduction}×100 (%).

When the diameter reduction is completed in the $\gamma$ phase zone, the steel pipe has to be cooled within 5 sec. after the diameter reduction at a cooling rate of 5° C./sec. or more to a temperature of $(Ar_3-100)$° C. or lower. If the cooling is commenced more than 5 sec. after the completion of the diameter reduction, the recrystallization of the $\gamma$ phase is accelerated or the variant selection at the $\gamma$ to $\alpha$ transformation becomes inappropriate and the r-value and the texture are finally deteriorated. If the cooling rate is below 5° C./sec., the variant selection at the transformation becomes inappropriate and the revalue and the texture are deteriorated.

A cooling rate of 10° C./sec. or more is preferable and, if it is 20° C./sec. or more, better still. The end point temperature of the cooling has to be $(Ar_3-100)$° C. or lower. This improves the texture formation in the $\gamma$ to a transformation. It is more preferable for forming the texture to continue cooling down to the temperature at which the $\gamma$ to $\alpha$ transformation is completed.

It is also acceptable to apply diameter reduction with a diameter reduction ratio of 40% or more in the $\gamma$ phase zone and then another diameter reduction under a diameter reduction ratio of 10% or more in a temperature range from $Ar_3$ to $(Ar_3-100)$° C. and complete the diameter reduction at a temperature from $Ar_3$ to $(Ar_3-100)$° C. as stated in the item (15) of the present invention. This accelerates the formation of the {111}<110> texture through transformation yet further. The diameter reduction ratio in the $\gamma+\alpha$ dual phase zone is defined as {(steel pipe diameter before diameter reduction at or below $Ar_3$–steel pipe diameter after diameter reduction completion from $Ar_3$ to $(Ar_3-100)$° C.)/steel pipe diameter before diameter reduction at or below $Ar_3$}×100(%).

The overall diameter reduction ratio of the steel pipe thus produced is, as a matter of course, 40% or more or, preferably, 60% or more. The overall diameter reduction ratio is defined as follows:

{(mother pipe diameter before diameter reduction–steel pipe diameter after diameter reduction)/mother pipe diameter before diameter reduction}×100(%).

It is preferable that the change ratio of the wall thickness of the steel pipe after the diameter reduction to the wall thickness of the mother pipe is controlled within a range of +10% to −10%. The wall thickness change ratio is defined as {(steel pipe wall thickness after completing diameter reduction–mother pipe wall thickness before diameter reduction)/mother pipe wall thickness before diameter reduction}×100(%).

Note that the diameter of a steel pipe is its outer diameter. It becomes difficult to form a good texture if the wall thickness after the diameter reduction is much larger than the initial wall thickness or, contrarily, if it is much smaller.

Then, the requirements specified in the items (12) and (13) of the present invention are explained hereafter.

The heating temperature prior to the diameter reduction of a steel pipe is important for obtaining a good n-value. If the heating temperature is below 850° C., a deformed structure is likely to remain after completing the diameter reduction, causing the n-value to fall. If it is below 850° C., it is possible to maintain a good n-value by reheating the steel pipe using induction heating or some other heating means during the diameter reduction, but this increases costs. 900° C. or above is a more preferable heating temperature range. When a good r-value is required, it is preferable to heat the mother pipe to the γ single phase zone. No specific upper limit is set regarding the heating temperature, but, if it is above 1,200° C., an excessive amount of scale forms on the pipe surface deteriorating not only surface quality but also formability. A more preferable upper limit is 1,050° C. or lower. The method of the heating is not specified, either, but it is preferable to heat the mother pipe rapidly by an induction heater in order to control the scale formation and maintain good surface quality.

The scale is removed after the heating with water or some other means as required.

The diameter reduction has to be applied so that the diameter reduction ratio is at least 20% or larger in the temperature range from below the $Ar_3$ transformation temperature to 750° C. or above. If the diameter reduction ratio in this temperature range is below 20%, it is difficult to obtain a good revalue and texture and, moreover, formability is deteriorated as a result of coarse grain formation. A diameter reduction ratio of 50% or more is preferable and, if it is 65% or more, better still. The effects of the present invention can be obtained without specifying an upper limit of the diameter reduction ratio, but 90% or less is preferable from a productivity viewpoint. The diameter reduction at the $Ar_3$ transformation temperature or above may precede another diameter reduction below the $Ar_3$ transformation temperature. This brings about an even better r-value. A temperature at the completion of the diameter reduction is also of great importance. The lower limit of the completion temperature is set at 750° C. If it is below 750° C., a deformed structure readily remains, deteriorating the n-value. A more preferable completion temperature is 780° C. or higher.

Note that the diameter reduction ratio below the $Ar_3$ transformation temperature is defined as {(steel pipe diameter immediately before diameter reduction below $Ar_3$−steel pipe diameter after completing diameter reduction)/steel pipe diameter immediately before diameter reduction below $Ar_3$}×100(%).

The diameter reduction has to be conducted so that the wall thickness change ratio is from +5% to −30%. Unless the wall thickness change ratio is in this range, it is difficult to obtain a good texture and r-value. A more preferable range is from −5% to −20%.

The wall thickness change ratio is defined as {(steel pipe wall thickness after completing diameter reduction−mother pipe wall thickness before diameter reduction)/mother pipe wall thickness before completing diameter reduction}×100 (%).

Here, the diameter of a steel pipe means its outer diameter. It is preferable that the temperature at the end of the diameter reduction is within the α+γ phase zone, because it is necessary, for obtaining a good texture, to impose a certain amount or more of the above diameter reduction on the α phase.

The diameter reduction may be applied by having a mother pipe pass through forming rolls combined to compose a multiple-pass forming line or by drawing it using dies. The application of lubrication during the diameter reduction is desirable for improving formability.

It is preferable for securing ductility that a steel pipe according to the present invention comprises ferrite of 30% or more in area percentage. But this is not necessarily true depending on the use of the pipe: the steel pipe for some specific uses may be composed solely of one or more of the following: pearlite, bainite, martensite, austenite, carbonitrides, etc.

A steel pipe according to the present invention covers both the one used without surface treatment and the one used after surface treatment for rust protection by hot dip plating, electroplating or other plating method. Pure zinc, an alloy containing zinc as the main component, Al, etc. may be used as the plating material. Normally practiced methods may be employed for the surface treatment.

EXAMPLE 1

The slabs of the steel grades having the chemical compositions shown in Table 1 were heated to 1,200° C., hot rolled at finishing temperatures listed in Table 2, and then coiled. The steel strips thus produced were pickled and formed into pipes 100 to 200 mm in outer diameter by the electric resistance welding method, and the pipes thus formed were heated to prescribed temperatures and then subjected to diameter reduction.

Formability of the steel pipes thus produced was evaluated in the following manner.

A scribed circle 10 mm in diameter was transcribed on each steel pipe beforehand and expansion forming in the circumferential direction was applied to it controlling inner pressure and the amount of axial compression. Axial strain $\epsilon\Phi$ and circumferential strain $\epsilon\Theta$ at the portion showing the largest expansion ratio immediately before bursting were measured (expansion ratio=largest circumference after forming/circumference of a mother pipe).

The ratio of the two strains $\rho=\epsilon\Phi/\epsilon\Theta$ and the maximum expansion ratio were plotted and the expansion ratio Re where ρ was −0.5 was defined as an indicator of the formability at the hydraulic forming. Arc section test pieces were cut out from the mother pipes before the diameter reduction and the steel pipes after the diameter reduction and were pressed into flat test pieces, and X-ray measurement was done on the flat test pieces thus prepared. Pole figures of (110), (200), (211) and (310) were measured, three-dimensional texture was calculated using the pole figures by the harmonic series expansion method and the ratio of the X-ray intensity in each of the crystal orientation components to the random X-ray intensity at a $\phi2=45°$ cross section was obtained.

Table 2 shows the ratios of the X-ray intensity in the orientation components of {001}<110>, {116}<110>, {114}<110> and {112}<110> on the plane at the center of the mother pipe wall thickness to the random X-ray intensity, and Table 3 shows the heating temperature prior to the diameter reduction, diameter reduction ratio, wall thickness reduction ratio, and the averages of the ratios of the X-ray intensity in the orientation component group of {110}<110> to {332}<110> and the X-ray intensity ratio in the orientation component of {110}<110> to the random X-ray intensity, tensile strength, axial r-value rL, and maximum expansion ratios at the hydraulic forming of the steel pipes after the diameter reduction.

Whereas all the samples according to the present invention have good textures and r-values and exhibit high maximum expansion ratios, the samples out of the scope of the present invention have poor textures and r-values and exhibit low maximum expansion ratios.

TABLE 1

| Steel grade | C | Si | Mn | P | S | Al | Ti | Nb | B | N | Others |
|---|---|---|---|---|---|---|---|---|---|---|---|
| A | 0.0025 | 0.01 | 1.12 | 0.065 | 0.005 | 0.050 | 0.022 | 0.016 | 0.0003 | 0.0019 | — |
| B | 0.018 | 0.02 | 0.12 | 0.022 | 0.004 | 0.015 | — | — | — | 0.0020 | — |
| C | 0.045 | 0.01 | 0.25 | 0.008 | 0.003 | 0.022 | — | — | 0.0019 | 0.0025 | — |
| D | 0.083 | 0.12 | 0.41 | 0.015 | 0.005 | 0.016 | — | — | — | 0.0025 | Sn = 0.02 |
| E | 0.088 | 0.01 | 0.82 | 0.022 | 0.003 | 0.050 | — | 0.020 | — | 0.0033 | — |
| F | 0.125 | 0.01 | 0.45 | 0.010 | 0.009 | 0.036 | — | — | — | 0.0024 | — |
| G | 0.291 | 0.20 | 1.01 | 0.024 | 0.003 | 0.031 | — | — | — | 0.0023 | Cr = 0.1 |

TABLE 2

| | | Hot rolling conditing | | | | | |
|---|---|---|---|---|---|---|---|
| | | Finish rolling | Coiling | *1 | | | |
| Steel grade | | temperature ° C. | tempera-ture ° C. | {001} <110> | {116} <110> | {114} <110> | {112} <110> |
| A | −1 | 926 | 730 | 2.4 | 1.9 | 1.3 | 0.9 |
| | −2 | 847 | 680 | 3.8 | 4.4 | 5.3 | 8.6 |
| B | −1 | 930 | 670 | 2.6 | 2.1 | 1.5 | 1.2 |
| | −2 | 710 | 500 | 5.7 | 4.1 | 3.3 | 1.8 |
| C | −1 | 914 | 600 | 3.5 | 2.8 | 2.3 | 1.5 |
| | −2 | 786 | 610 | 11.2 | 8.6 | 5.9 | 2.9 |
| D | −1 | 895 | 510 | 1.6 | 1.4 | 1.4 | 1.3 |
| | −2 | 732 | 605 | 7.2 | 6.5 | 5.7 | 4 |

TABLE 2-continued

| | | Hot rolling conditing | | | | | |
|---|---|---|---|---|---|---|---|
| | | Finish rolling | Coiling | *1 | | | |
| Steel grade | | temperature ° C. | tempera-ture ° C. | {001} <110> | {116} <110> | {114} <110> | {112} <110> |
| E | −1 | 920 | 745 | 4.2 | 3.3 | 2.4 | 2.2 |
| | −2 | 811 | 670 | 4.1 | 6.3 | 9.6 | 12.2 |
| F | −1 | 910 | 680 | 2.7 | 2.1 | 1.8 | 1.8 |
| | −2 | 675 | 420 | 8.6 | 7.2 | 5 | 3.7 |
| G | −1 | 865 | 610 | 2.9 | 2.4 | 1.4 | 1 |
| | −2 | 772 | 550 | 5.5 | 6.3 | 8 | 9.9 |

*1 Ratio of x-ray intensity in each of orientation components to random X-ray intensity at the mother pipe wall thickness center.

TABLE 3

| | | Diameter reduction conditions | | | | Properties of steel pipe after diameter reduction | | | | | | |
|---|---|---|---|---|---|---|---|---|---|---|---|---|
| Steel grade | | $Ac_3$ ° C. | Heating temperature ° C. | Diameter reduction ratio % | Wall thickness reduction ratio % | Tensile strength MPa | *2 | *3 | *4 | rL | Maximum expansion ratio | Classification |
| A | 1-1 | 872 | 970 | 58 | 20 | 390 | 4.5 | 5.5 | 0.6 | 2.4 | 1.55 | Within scope of invention |
| | 1-2 | | 970 | 35 | −10 | 388 | 2.6 | 2.5 | 0.9 | 1.1 | 1.42 | Out of scope of invention |
| | 2-1 | | 980 | 50 | 15 | 398 | 3.9 | 5 | 0.6 | 2.0 | 1.51 | Within scope of invention |
| | 2-2 | | 780 | 50 | 15 | 435 | 1.8 | 2.3 | 1 | 0.7 | 1.28 | Out of scope of invention |
| B | 1-1 | 885 | 800 | 70 | 15 | 298 | 7.5 | 8.9 | 0.3 | 3.5 | 1.67 | Within scope of invention |
| | 1-2 | | 800 | 25 | 15 | 301 | 2.1 | 1.5 | 1.2 | 0.5 | 1.36 | Out of scope of invention |
| | 2-1 | | 960 | 60 | 10 | 283 | 8.9 | 12.4 | 0.2 | 5.7 | 1.78 | Within scope of invention |
| | 2-2 | | 750 | 60 | 0 | 315 | 3.3 | 3.4 | 0.8 | 0.8 | 1.34 | Out of scope of invention |
| C | 1-1 | 866 | 940 | 80 | 25 | 322 | 7.8 | 11 | 0.3 | 2.7 | 1.51 | Within scope of invention |
| | 1-2 | | 940 | 25 | 5 | 316 | 2 | 1.6 | 0.7 | 0.5 | 1.33 | Out of scope of invention |
| | 2-1 | | 940 | 60 | 10 | 325 | 6.6 | 7.2 | 0.4 | 1.7 | 1.47 | Within scope of invention |
| | 2-2 | | 740 | 60 | 10 | 357 | 1.3 | 0.9 | 0.3 | 0.3 | 1.14 | Out of scope of invention |
| D | 1-1 | 851 | 780 | 40 | 20 | 394 | 4.7 | 3.8 | 0.6 | 1.5 | 1.43 | Within scope of invention |
| | 1-2 | | 980 | 40 | −15 | 376 | 3.1 | 2.2 | 0.5 | 0.9 | 1.38 | Out of scope of invention |
| | 2-1 | | 950 | 40 | 10 | 400 | 4.1 | 2.5 | 0.7 | 1.6 | 1.44 | Within scope of invention |
| | 2-2 | | 950 | 25 | 0 | 395 | 1.9 | 2.1 | 0.8 | 0.8 | 1.36 | Out of scope of invention |
| E | 1-1 | 834 | 850 | 65 | 15 | 523 | 10.3 | 14.9 | 0.1 | 4.2 | 1.46 | Within scope of invention |
| | 1-2 | | 750 | 65 | 10 | 590 | 3.2 | 3.7 | 0.6 | # | 1.24 | Out of scope of invention |
| | 2-1 | | 850 | 50 | 10 | 510 | 5.4 | 5.8 | 0.5 | 2.0 | 1.36 | Within scope of invention |
| | 2-2 | | 750 | 50 | −20 | 575 | 3.3 | 3.1 | 0.2 | 0.4 | 1.18 | Out of scope of invention |
| F | 1-1 | 827 | 800 | 45 | 15 | 513 | 4.8 | 4.4 | 0.4 | 1.6 | 1.42 | Within scope of invention |
| | 1-2 | | 800 | 45 | −10 | 505 | 2.8 | 2.4 | 0.9 | 0.7 | 1.33 | Out of scope of invention |
| | 2-1 | | 800 | 45 | 20 | 520 | 4.4 | 4.5 | 0.4 | 1.6 | 1.43 | Within scope of invention |
| | 2-2 | | 800 | 20 | −15 | 518 | 1.6 | 1.8 | 1.1 | 0.5 | 1.27 | Out of scope of invention |

TABLE 3-continued

| Steel grade | Ac$_3$ ° C. | Diameter reduction conditions: Heating temperature ° C. | Diameter reduction ratio % | Wall thickness reduction ratio % | Properties of steel pipe after diameter reduction: Tensile strength MPa | *2 | *3 | *4 | rL | Maximum expansion ratio | Classification |
|---|---|---|---|---|---|---|---|---|---|---|---|
| G 1-1 | 803 | 940 | 60 | 15 | 625 | 8.5 | 6.5 | 0.3 | 1.9 | 1.42 | Within scope of inventiom |
| 1-2 | | 600 | 60 | 15 | 720 | 3.3 | 4.1 | 0.7 | # | 1.05 | Out of scope of invention |
| 2-1 | | 900 | 75 | 15 | 630 | 9.5 | 11.1 | 0.2 | 2.6 | 1.45 | Within scope of invention |
| 2-2 | | 720 | 75 | 15 | 654 | 3.2 | 1.7 | 0.4 | 0.4 | 1.18 | Out of scope of invention |

*2: Average of ratios of X-ray intensity in orientation component group of {110}<110> to {332}<110) to random X-ray intensity
*3: Ratio of X-ray intensity in orientation component of {110}<110> to random X-ray intensity
*4: Ratio of X-ray intensity in orientation component of {111}<112> to random X-ray intensity
#: r-value not measurable owing to imsufficient elongation.

The present invention brings about the texture of a steel material excellent in the formability of hydraulic forming and the like and a method to control the texture, and makes it possible to produce a steel pipe excellent in the formability of hydraulic forming and the like.

EXAMPLE 2

The slabs of the steel grades having the chemical compositions shown in Table 4 were heated to 1,230° C., hot rolled at finishing temperatures listed also in Table 4, and then coiled. The steel strips thus produced were pickled and formed into pipes 100 to 200 mm in diameter by the electric resistance welding method, and the pipes thus formed were heated to prescribed temperatures and then subjected to diameter reduction.

Formability of the steel pipes thus produced was evaluated in the following manner.

A scribed circle 10 mm in diameter was transcribed on each steel pipe beforehand and expansion forming in the circumferential direction was applied to it controlling inner pressure and the amount of axial compression. Axial strain $\epsilon\Phi$ and circumferential strain $\epsilon\Theta$ at the portion showing the largest expansion ratio immediately before bursting were measured (expansion ratio=largest circumference after forming/circumference of a mother pipe).

The ratio of the two strains $\rho=\epsilon\Phi/\epsilon\Theta$ and the maximum expansion ratio were plotted and the expansion ratio Re where $\rho$ was −0.5 was defined as an indicator of the formability at the hydraulic forming.

Arc section test pieces were cut out from the mother pipes before the diameter reduction and the steel pipes after the diameter reduction and were pressed into flat test pieces, and X-ray measurement was done on the flat test pieces thus prepared. Pole figures of (110), (200), (211) and (310) were measured, three-dimensional texture was calculated using the pole figures by the harmonic series expansion method and the ratio of the X-ray intensity in each of the crystal orientation components to the random X-ray intensity at $\phi2=45°$ cross section was obtained.

Table 5 shows the conditions of the diameter reduction and the properties of the steel pipes after the diameter reduction. In the table, rL means the axial r-value, r45 the r-value in the 45° direction and rC the same in the circumferential direction.

Whereas all the samples according to the present invention have good textures and r-values and exhibit high maximum expansion ratios in the hydraulic forming, the samples out of the scope of the present invention have poor textures and r-values and exhibit low maximum expansion ratios.

TABLE 4

| Steel grade | C | Si | Mn | P | S | Al | Ti | Nb | B | N | Others | Mn +13Ti + 29Nb | Remarks |
|---|---|---|---|---|---|---|---|---|---|---|---|---|---|
| A | 0.0025 | 0.01 | 1.25 | 0.065 | 0.005 | 0.042 | 0.016 | 0.015 | 0.0005 | 0.0019 | — | 1.89 | Invented steel |
| B | 0.0021 | 0.01 | 0.12 | 0.008 | 0.004 | 0.045 | 0.022 | — | — | 0.0024 | — | 0.41 | Comparative steel |
| C | 0.017 | 0.02 | 0.11 | 0.008 | 0.004 | 0.043 | — | 0.035 | — | 0.0020 | Sn = 0.02 | 1.13 | Invented steel |
| D | 0.018 | 0.01 | 0.15 | 0.065 | 0.006 | 0.052 | — | — | — | 0.0018 | — | 0.15 | Comparative steel |
| E | 0.045 | 0.01 | 0.29 | 0.005 | 0.006 | 0.016 | — | 0.042 | 0.0005 | 0.0025 | Cr = 0.15 | 1.51 | Invented steel |
| F | 0.043 | 0.03 | 0.25 | 0.004 | 0.004 | 0.015 | 0.015 | — | — | 0.0026 | — | 0.45 | Comparative steel |
| G | 0.079 | 0.08 | 0.94 | 0.016 | 0.006 | 0.025 | 0.012 | 0.058 | — | 0.0029 | — | 2.78 | Invented steel |
| H | 0.083 | 0.04 | 0.14 | 0.015 | 0.005 | 0.041 | — | 0.010 | 0.0002 | 0.0030 | — | 0.43 | Comparative steel |
| I | 0.125 | 0.03 | 1.16 | 0.006 | 0.002 | 0.045 | — | — | — | 0.0018 | — | 1.16 | Invented steel |
| J | 0.121 | 0.03 | 0.36 | 0.006 | 0.003 | 0.050 | — | — | — | 0.0023 | — | 0.36 | Comparative steel |
| K | 0.0031 | 0.30 | 0.54 | 0.048 | 0.008 | 0.044 | 0.019 | 0.015 | — | 0.0025 | V = 0.023 | 1.22 | Invented steel |
| L | 0.038 | 0.12 | 0.35 | 0.006 | 0.004 | 0.016 | 0.021 | 0.014 | — | 0.0023 | Mo = 0.15 | 1.03 | Invented steel |
| M | 0.053 | 1.20 | 1.19 | 0.004 | 0.002 | 0.025 | — | — | — | 0.0019 | Ca = 0.002 | 1.20 | Invented steel |

TABLE 5

| | Trans-formation temperature | | Diameter reduction conditions | | | Properties of steel pipe after diameter reduction | | |
|---|---|---|---|---|---|---|---|---|
| Steel grade | $Ac_3$ ° C. | $Ar_3$ ° C. | Heating temperature ° C. | Diameter reduction ratio % at at $Ar_3$ or above | Diameter reduction ratio % at $Ar_3$ to ($Ar_3$-100) ° C. | Diameter reduction end tempera-ture ° C. | Cooling commencement time sec. | Cooling rate ° C./sec. |
| A | 900 | 832 | 990 | 60 | 0 | 840 | 2 | 15 |
| | | | 990 | 20 | 0 | 840 | 2 | 3 |
| B | 921 | 889 | 1000 | 50 | 0 | 900 | 3 | 20 |
| C | 919 | 856 | 1010 | 75 | 0 | 870 | 0 | 6 (Left to cool naturally) |
| | | | 1010 | 75 | 0 | 870 | 10 | 10 |
| D | 927 | 901 | 700 | 0 | 0 | 550 | 1 | 20 |
| E | 892 | 813 | 980 | 80 | 0 | 820 | 1 | 30 |
| | | | 980 | 30 | 0 | 820 | 1 | 30 |
| F | 888 | 858 | 980 | 60 | 0 | 865 | 1 | 30 |
| G | 845 | 724 | 1020 | 70 | 0 | 840 | 2 | 10 |
| | | | 1020 | 70 | 0 | 840 | 2 | 10 |
| H | 879 | 820 | 1020 | 70 | 0 | 840 | 2 | 10 |
| I | 826 | 787 | 940 | 60 | 0 | 800 | 1 | 15 |
| | | | 940 | 60 | 0 | 800 | 6 | 3 |
| J | 850 | 805 | 940 | 60 | 0 | 820 | 1 | 15 |
| K | 925 | 873 | 1040 | 60 | 15 | 800 | 0*3 | 5 (Left to cool naturally) |
| L | 888 | 836 | 1000 | 60 | 20 | 780 | 0*3 | 6 (Left to cool naturally) |
| M | 905 | 834 | 1000 | 60 | 25 | 720 | 0*3 | 7 (Left to cool naturally) |

| | Properties of steel pipe after diameter reduction | | | | | | | | | |
|---|---|---|---|---|---|---|---|---|---|---|
| Steel grade | Cooling and tempera-ture ° C. | Wall thickness change ratio % | Tensile strength MPa | *1 | *2 | rL | r45 | rc | Maximum expansion ratio | Classification |
| A | 700 | 0 | 405 | 7.7 | 0.8 | 2.3 | 2.0 | 1.8 | 1.52 | Within scope of invention |
| | 700 | 0 | 389 | 2.2 | 1.4 | 1.1 | 0.8 | 0.9 | 1.42 | Out of scope of invention |
| B | 650 | +5 | 281 | 1.6 | 0.5 | 0.9 | 0.7 | 0.7 | 1.44 | Out of scope of invention |
| C | Room tempera-ture | −5 | 382 | 6.3 | 1.4 | 1.8 | 1.7 | 1.6 | 1.48 | Within scope of invention |
| | 680 | −5 | 365 | 3.2 | 1.8 | 1.2 | 0.6 | 1.0 | 1.41 | Out of scope of invention |
| D | 500 | 0 | 354 | 3.9 | 0.9 | # | # | # | 1.08 | Out of scope of invention |
| E | 700 | 0 | 437 | 9.4 | 0.9 | 2.6 | 2.2 | 1.9 | 1.48 | Within scope of invention |
| | 700 | 0 | 423 | 2.8 | 2.2 | 0.9 | 0.6 | 0.7 | 1.39 | Out of scope of invention |
| F | 700 | 0 | 351 | 3.3 | 1.6 | 1.1 | 0.9 | 0.9 | 1.38 | Out of scope of invention |
| G | 650 | −5 | 611 | 10.8 | 1.7 | 2.2 | 2.0 | 2.1 | 1.42 | Within scope of invention |
| | 650 | −35 | 615 | 2.5 | 0.6 | 0.7 | 1.4 | 0.5 | 1.33 | Out of scope of invention |
| H | 650 | −5 | 618 | 4.2 | 2.3 | 1.3 | 1.2 | 1.0 | 1.37 | Out of scope of invention |
| I | 650 | 0 | 656 | 7.0 | 1.2 | 1.8 | 1.7 | 1.7 | 1.43 | Within scope of invention |
| | 770 | 0 | 639 | 1.8 | 1.4 | 0.8 | 0.6 | 0.8 | 1.38 | Out of scope of invention |
| J | 700 | 0 | 580 | 3.8 | 2.0 | 1.2 | 1.0 | 0.8 | 1.36 | Out of scope of invention |
| K | Room tempera-ture | 0 | 421 | 6.3 | 1.2 | 1.8 | 1.7 | 1.5 | 1.53 | Within scope of invention |

TABLE 5-continued

| | | | | | | | | | | |
|---|---|---|---|---|---|---|---|---|---|---|
| L | Room temperature | 0 | 349 | 10.0 | 0.9 | 2.5 | 2.2 | 2.0 | 1.57 | Within scope of invention |
| M | Room temperature | 0 | 523 | 11.5 | 1.4 | 2.6 | 2.3 | 2.2 | 1.46 | Within scope of invention |

*1: Ratio of X-ray intensity in orientation component of {111}<110> to random X-ray intensity
*2: Ratio of X-ray intensity in orientation component of {111}<112> to random X-ray intensity
*3: Left to cool naturally to room temperature after diameter reduction.
#: r-value not measurable owing to insufficient elongation.

EXAMPLE 3

The hot rolled steel sheets having the chemical compositions shown in Table 6 were pickled and formed into pipes 100 to 200 mm in outer diameter by the electric resistance welding method, and the pipes thus formed were heated to prescribed temperatures and then subjected to diameter reduction.

Formability of the steel pipes thus produced was evaluated in the following manner.

A scribed circle 10 mm in diameter was transcribed on each steel pipe beforehand and expansion forming in the circumferential direction was applied to it controlling inner pressure and the amount of axial compression. Axial strain $\epsilon\Phi$ and circumferential strain $\epsilon\Theta$ at the portion showing the largest expansion ratio immediately before bursting were measured (expansion ratio=largest circumference after forming/circumference of a mother pipe).

The ratio of the two strains $\rho=\epsilon\Phi/\epsilon\Theta$ and the maximum expansion ratio were plotted and the expansion ratio Re where $\rho$ was −0.5 was defined as an indicator of the formability at the hydraulic forming. Mechanical properties of the steel pipes were evaluated using JIS No. 12 arc section test pieces. The r-values, which were influenced by the test piece shape, were measured attaching a strain gauge to each of the arc section test pieces. Other arc section test pieces were cut out from the steel pipes after the diameter reduction and were pressed into flat test pieces, and X-ray measurement was done on the flat test pieces thus prepared. Pole figures of (110), (200), (211) and (310) were measured, three-dimensional texture was calculated using the pole figures by the harmonic series expansion method and the ratio of the X-ray intensity in each of the crystal orientation components to the random X-ray intensity at a $\phi2=45°$ cross section was obtained.

Tables 7 and 8 list the heating temperatures prior to the diameter reduction, temperature at the end of the diameter reduction, diameter reduction ratio, wall thickness reduction ratio, and tensile strength, n-value, ferrite percentage, average crystal grain size, aspect ratio, axial r-value, and maximum expansion ratio at hydraulic forming of the steel pipes, and the averages of the ratios of the X-ray intensity in the orientation component group of {110}<110> to {332}<110> and the X-ray intensity in the orientation components of {111}<112>, {110}<110>, {441}<110> and {221}<110> at the center of the mother pipe wall thickness to the random X-ray intensity. Whereas all the samples according to the present invention have good formability and exhibit high maximum expansion ratios, the samples out of the scope of the present invention exhibit low maximum expansion ratios.

TABLE 6

| Steel grade | C | Si | Mn | P | S | Al | Ti | Nb | B | N | Ni | Cr |
|---|---|---|---|---|---|---|---|---|---|---|---|---|
| A | 0.0022 | 0.68 | 0.12 | 0.112 | 0.005 | 0.044 | 0.053 | — | 0.0005 | 0.0019 | — | — |
| B | 0.0021 | 0.01 | 0.09 | 0.005 | 0.004 | 0.042 | 0.019 | 0.015 | — | 0.0022 | — | — |
| C | 0.0016 | 0.35 | 0.64 | 0.070 | 0.004 | 0.256 | — | 0.024 | 0.0009 | 0.0023 | — | — |
| D | 0.016 | 0.02 | 0.11 | 0.069 | 0.003 | 0.510 | — | — | — | 0.0020 | — | — |
| E | 0.018 | 0.03 | 0.26 | 0.011 | 0.006 | 0.053 | — | — | — | 0.0018 | — | — |
| F | 0.051 | 2.03 | 1.23 | 0.026 | 0.002 | 0.146 | 0.045 | — | 0.0002 | 0.0025 | — | 0.18 |
| G | 0.045 | 0.03 | 0.25 | 0.004 | 0.004 | 0.015 | — | — | 0.0026 | 0.0017 | — | — |
| H | 0.069 | 0.04 | 0.92 | 0.006 | 0.001 | 0.031 | 0.009 | 0.047 | — | 0.0027 | — | — |
| I | 0.064 | 0.01 | 1.05 | 0.015 | 0.003 | 1.343 | — | 0.060 | — | 0.0031 | — | — |
| J | 0.118 | 0.64 | 1.30 | 0.012 | 0.002 | 0.046 | — | — | — | 0.0020 | 0.11 | 0.10 |
| K | 0.122 | 1.78 | 0.25 | 0.026 | 0.003 | 0.066 | — | — | — | 0.0025 | — | — |
| L | 0.167 | 0.67 | 0.51 | 0.021 | 0.005 | 0.519 | — | 0.015 | — | 0.0022 | — | — |
| M | 0.165 | 0.04 | 1.40 | 0.007 | 0.004 | 0.019 | — | — | — | 0.0026 | — | — |

| Steel grade | Cu | Mo | V | Others | Value of expression (1) | Value of expression (2) | Remarks |
|---|---|---|---|---|---|---|---|
| A | — | — | — | Sn = 0.02 | −104.5 | 117.60 | Invented steel |
| B | — | — | — | — | −0.3 | 12.35 | Comparative steel |
| C | — | — | — | — | −88.5 | 115.85 | Invented steel |
| D | — | 0.12 | — | — | −125.0 | 151.19 | Invented steel |
| E | — | — | — | — | 15.4 | 19.64 | Comparative steel |
| F | — | — | — | — | −53.4 | 138.14 | Invented steel |
| G | — | — | — | — | 43.4 | 7.11 | Comparative steel |

TABLE 6-continued

| | | | | | | | |
|---|---|---|---|---|---|---|---|
| H | — | — | — | Ca = 0.002 | 76.0 | 12.19 | Comparative steel |
| I | — | — | — | — | −189.2 | 279.55 | Invented steel |
| J | 0.23 | — | — | — | 69.9 | 46.21 | Comparative steel |
| K | — | 0.09 | 0.017 | — | −40.3 | 110.97 | Invented steel |
| L | — | — | — | — | −50.2 | 148.45 | Invented steel |
| M | — | — | — | — | 114.0 | 10.49 | Comparative steel |

TABLE 7

| Steel | Transformation temperature | | Diameter reduction conditions | | | | | |
|---|---|---|---|---|---|---|---|---|
| | | | Heating temperature | Overall diameter reduction | Diameter reduction ratio below | Diameter reduction commencement | Diameter reduction end temperature | Wall thickness change ratio |
| grade | $Ac_3$ ° C. | $Ar_3$ ° C. | ° C. | ratio % | $Ar_3$ % | temperature ° C. | ° C. | % |
| A | 1010 | 955 | 1050 | 70 | 70 | 950 | 830 | −10 |
| | | | 1050 | 70 | 70 | 800 | 690 | −10 |
| B | 918 | 849 | 900 | 50 | 50 | 770 | 640 | 0 |
| C | 991 | 963 | 1000 | 60 | 60 | 910 | 800 | −20 |
| | | | 1000 | 30 | 30 | 910 | 840 | −5 |
| D | 1034 | 1007 | 1050 | 40 | 40 | 920 | 810 | −15 |
| E | 902 | 826 | 1050 | 65 | 15 | 920 | 800 | +15 |
| F | 963 | 914 | 1050 | 70 | 55 | 980 | 820 | −25 |
| | | | 1050 | 70 | 70 | 900 | 780 | −25 |
| | | | 1050 | 70 | 0 | 1100 | 930 | −10 |
| | | | 840 | 70 | 70 | 750 | 600 | −10 |
| G | 865 | 768 | 840 | 60 | 60 | 700 | 700 | 0 |
| H | 936 | 715 | 950 | 75 | 0 | 850 | 750 | −10 |
| I | 1074 | 957 | 950 | 60 | 60 | 800 | 780 | −10 |
| J | 835 | 785 | 950 | 40 | 20 | 850 | 690 | 0 |
| K | 957 | 855 | 890 | 50 | 50 | 840 | 790 | −20 |
| L | 966 | 842 | 1000 | 75 | 60 | 880 | 770 | −15 |
| M | 784 | 703 | 800 | 75 | 75 | 680 | 550 | −15 |

TABLE 8

| Steel grade | Properties of steel pipe after diameter reduction | | | | | | | | | | | | | | |
|---|---|---|---|---|---|---|---|---|---|---|---|---|---|---|---|
| | Tensile strength Mpa | n | Right side of expression (3) | Volume percentage of ferrite phase % | Average crystal grain size of ferrite μm | Aspect ratio of ferrite | A | Axial r-value | *1 | *2 | *3 | *4 | *5 | Maximum expansion ratio | Classification |
| A | 369 | 0.24 | 0.20 | 100 | 34 | 1.4 | 100 | 4.1 | 6.8 | 8.1 | 8.2 | 7.9 | 0.4 | 1.78 | Within scope of invention |
| | 389 | 0.13 | 0.19 | 100 | ** | 10.4 | 11 | 1.8 | 0.8 | 0.7 | 0.8 | 0.7 | 0.9 | 1.45 | Out of scope of invention |
| B | 324 | 0.05 | 0.21 | 100 | ** | 3.9 | 16 | # | 1.4 | 1.9 | 2.0 | 1.6 | 1.2 | 1.06 | Out of scope of invention |
| C | 422 | 0.22 | 0.18 | 100 | 29 | 1.3 | 100 | 2.7 | 5.6 | 4.8 | 4.2 | 4.7 | 0.3 | 1.56 | Within scope of invention |
| | 409 | 0.23 | 0.18 | 100 | 32 | 1.6 | 100 | 1.7 | 2.7 | 3.9 | 5.1 | 3.7 | 0.8 | 1.51 | Within scope of invention |
| D | 364 | 0.25 | 0.20 | 97 | 38 | 1.2 | 100 | 5.6 | 8.9 | 8.8 | 7.1 | 8.4 | 0.2 | 1.84 | Within scope of invention |
| E | 292 | 0.21 | 0.22 | 96 | 16 | 1.2 | 99 | 0.8 | 1.3 | 1.3 | 1.0 | 1.1 | 1.8 | 1.43 | Out of scope of invention |
| F | 605 | 0.16 | 0.13 | 96 | 25 | 1.3 | 100 | 3.6 | 6.6 | 7.0 | 8.8 | 8.1 | 0.3 | 1.60 | Within scope of invention |
| | 590 | 0.17 | 0.14 | 96 | 27 | 1.3 | 100 | 3.1 | 6.0 | 5.8 | 5.2 | 5.6 | 0.4 | 1.59 | Within scope of invention |
| | 622 | 0.12 | 0.13 | 97 | 9 | 1.0 | 100 | 0.8 | 1.2 | 1.1 | 1.0 | 1.1 | 1.6 | 1.36 | Out of scope of invention |
| | 649 | 0.05 | 0.12 | 94 | ** | 11.0 | 8 | # | 4.2 | 4.5 | 4.3 | 4.4 | 0.6 | 1.08 | Out of scope of invention |
| G | 356 | 0.14 | 0.20 | 95 | ** | 5.7 | 6 | 1.9 | 3.5 | 3.5 | 3.2 | 3.4 | 1.2 | 1.46 | Out of scope of invention |
| H | 481 | 0.14 | 0.16 | 98 | 7 | 1.0 | 100 | 1.7 | 1.3 | 2.9 | 5.1 | 3.5 | 1.7 | 1.44 | Out of scope of invention |
| I | 479 | 0.19 | 0.16 | 92 | 30 | 1.4 | 100 | 6.0 | 11.9 | 13.4 | 10.6 | 12.5 | 0.3 | 1.90 | Within out of invention |

TABLE 8-continued

| Steel grade | Tensile strength Mpa | n | Right side of expression (3) | Volume percentage of ferrite phase % | Average crystal grain size of ferrite μm | Aspect ratio of ferrite | A | Axial r-value | *1 | *2 | *3 | *4 | *5 | Maximum expansion ratio | Classification |
|---|---|---|---|---|---|---|---|---|---|---|---|---|---|---|---|
| | Properties of steel pipe after diameter reduction | | | | | | | | | | | | | | |
| J | 507 | 0.14 | 0.16 | 91 | ** | 3.5 | 79 | 1.2 | 1.8 | 1.8 | 1.9 | 1.8 | 1.1 | 1.40 | Out of scope of invention |
| K | 753 | 0.14 | 0.11 | 86 | 21 | 1.3 | 100 | 1.6 | 3.9 | 3.0 | 2.4 | 3.1 | 0.7 | 1.44 | Within scope of invention |
| L | 688 | 0.15 | 0.12 | 85 | 23 | 1.5 | 100 | 4.2 | 11.0 | 10.0 | 10.4 | 10.6 | 0.2 | 1.63 | Within scope of invention |
| M | 710 | 0.03 | 0.11 | 81 | ** | 11.6 | 2 | # | 4.6 | 4.2 | 3.7 | 4.3 | 0.5 | 1.03 | Out of scope of invention |

Right side of expression (3) = −0.126 × 1n(Ts) + 0.94
A: Volume percentage of ferrite grains having aspect ratio of 0.5 to 3.0 in ferrite phase.
*1: Ratio of X-ray intensity in orientation component of {111}<110> to random X-ray intensity
*2: Ratio of X-ray intensity in orientation component of {441}<110> to random X-ray intensity
*3: Ratio of X-ray intensity in orientation component of {221}<110> to random X-ray intensity
*4: Average of ratios of X-ray intensity in orientation component group of {110}<110> to {332}<110> to random X-ray intensity
*5: Ratio of X-ray intensity in orientation component of {111}<112> to random X-ray intensity
*: r-value not measurable owing to insufficient elongation.
**: Crystal grain size not measurable owing to residual deformed structure.

Industrial Applicability

The present invention brings about a texture of a steel material excellent in formability during hydraulic forming and the like and a method to control the texture, and makes it possible to produce a steel pipe excellent in the formability of hydraulic forming and the like.

What is claimed is:

1. A steel pipe, excellent in formability, having a chemical composition comprising, in mass, 0.0001 to 0.50% of C, 0.001 to 2.5% of Si, 0.01 to 3.0% of Mn, 0.001 to 0.2% of P, 0.05% or less of S and 0.01% or less of N, with the balance consisting of Fe and unavoidable impurities, characterized by having: an r-value of 1.4 or larger in the axial direction of the steel pipe; and the property that the average of the ratios of the X-ray intensity in the orientation component group of {110}<110> to {332}<110> on the plane at the center of the steel pipe wall thickness to the random X-ray intensity is 3.5 or larger, and/or the ratio of the X-ray intensity in the orientation component of {110}<110> on the plane at the center of the steel pipe wall thickness to the random X-ray intensity is 5.0 or larger.

2. A steel pipe, excellent in formability, according to claim 1 characterized by further containing 0.001 to 0.5 mass % of Al.

3. A steel pipe, excellent in formability, having a chemical composition comprising, in mass, 0.0001 to 0.50% of C, 0.001 to 2.5% of Si, 0.01 to 3.0% of Mn, 0.001 to 0.2% of P, 0.05% or less of S, 0.01% or less of N, 0.01 to 2.5% of Al and 0.01% or less of O in a manner to satisfy the expressions (1) and (2) below, with the balance consisting of Fe and unavoidable impurities, characterized in that: the relationship between the tensile strength (TS) and the n-value of the steel pipe satisfies the expression (3) below; the volume percentage of its ferrite phase is 75% or more; the average grain size of the ferrite is 10 μm or more; and the crystal grains of the ferrite having an aspect ratio of 0.5 to 3.0 account for, in area percentage, 90% or more of all the crystal grains composing the ferrite, $$(203\sqrt{C}+15.2Ni-44.7Si-104V-31.5Mo+30Mn+11Cr+20Cu-700P-200Al)<-20 \quad (1)$$

$$(44.7Si+700P+200Al)>80 \quad (2)$$

$$n \geqq -0.126\times\ln(TS)+0.94 \quad (3).$$

4. A steel pipe, excellent in formability, according to claim 3, characterized by having: an r-value of 1.0 or larger in the longitudinal direction of the steel pipe; and the property that the average of the ratios of the X-ray intensity in the orientation component group of {110}<110> to {332}<110> to the random X-ray intensity is 2.0 or larger and the ratio of the X-ray intensity in the orientation component of {111}<112> to the random X-ray intensity is 1.5 or smaller on the plane at the center of the steel pipe wall thickness.

5. A steel pipe, excellent in formability, having a chemical composition comprising, in mass, 0.0001 to 0.50% of C, 0.001 to 2.5% of Si, 0.01 to 3.0% of Mn, 0.001 to 0.2% of P, 0.05% or less of S, 0.01% or less of N, 0.2% or less of Ti and 0.15% or less of Nb in a manner to satisfy the expression $0.5 \leqq (Mn+13Ti+29Nb) \leqq 5$, with the balance consisting of Fe and unavoidable impurities, characterized by having the property that the ratio of the X-ray intensity in the orientation components of {111}<110> on the plane at the center of the steel pipe wall thickness to the random X-ray intensity is 5.0 or larger and the ratio of the X-ray intensity in the orientation component of {111}<112> on the plane at the center of the steel pipe wall thickness to the random X-ray intensity is below 2.0.

6. A steel pipe, excellent in formability, according to claim 5 characterized by further containing 0.001 to 0.5 mass % of Al.

7. A method to produce a steel pipe, excellent in formability, having a chemical composition comprising, in mass, 0.0001 to 0.50% of C, 0.001 to 2.5% of Si, 0.01 to 3.0% of Mn, 0.001 to 0.2% of P, 0.05% or less of S and 0.01% or less of N, with the balance consisting of Fe and unavoidable impurities, characterized by heating the steel pipe, having the property that the ratio of the X-ray intensity in every one of the orientation components of {001}<110>, {116}<110>, {114}<110> and {112}<110> on the plane at the center of the wall thickness of the mother pipe before diameter reduction to the random X-ray intensity is 3 or smaller, to a temperature in the range from 650° C. or higher to 1,200° C. or lower and by applying working under a condition of a diameter reduction ratio of 30% or more and a wall thickness reduction ratio of 5% or more to 30% or less, so that the steel pipe has an r-value of 1.4 or larger in the axial direction of the steel pipe and the property that the average of the ratios of the X-ray intensity in the orientation component group of {110}<110> to {332}<110> on the plane at the center of the steel pipe wall thickness to the random X-ray intensity is 3.5 or larger, and/or the ratio of the X-ray intensity in the orientation component of {110}<110> on the plane at the center of the steel pipe wall thickness to the random X-ray intensity is 5.0 or larger.

8. A method to produce a steel pipe, excellent in formability, having a chemical composition comprising, in mass, 0.0001 to 0.50% of C, 0.001 to 2.5% of Si, 0.01 to 3.0% of Mn, 0.001 to 0.2% of P, 0.05% or less of S and 0.01% or less of N, with the balance consisting of Fe and unavoidable impurities, characterized by heating the steel pipe, having the property that the ratio of the X-ray intensity in one or more of the orientation components of {001}<110>, {116}<110>, {114}<110> and {112}<110> on the plane at the center of the wall thickness of the mother pipe before diameter reduction to the random X-ray intensity exceeds 3 to a temperature in the range from $(Ac_3-50)$° C. or higher, to 1,200° C. or lower and by applying working under a condition of a diameter reduction ratio of 30% or more and a wall thickness reduction ratio of 5% or more to 30% or less, so that the steel pipe has an r-value of 1.4 or larger in the axial direction of the steel pipe and the property that the average of the ratios of the X-ray intensity in the orientation component group of {110}<110> to {332}<110> on the plane at the center of the steel pipe wall thickness to the random X-ray intensity is 3.5 or larger, and/or the ratios of the X-ray intensity in the orientation component of {110}<110> on the plane at the center of the steel pipe wall thickness to the random X-ray intensity is 5.0 or larger.

9. A method to produce a steel pipe, excellent in formability, having a chemical composition comprising, in mass, 0.0001 to 0.50% of C, 0.001 to 2.5% of Si, 0.01 to 3.0% of Mn, 0.001 to 0.2% of P, 0.05% or less of S, 0.01% or less of N, 0.01 to 2.5% of Al and 0.01% or less of O in a manner to satisfy the expressions (1) and (2) below, with the balance consisting of Fe and unavoidable impurities, characterized by heating the mother pipe to 850° C. or higher at diameter reduction, applying the diameter reduction under a diameter reduction ratio of 20% or more in the temperature range from below the $Ar_3$ transformation temperature to 750° C. or higher and completing the diameter reduction at 750° C. or higher; so that the relationship between the tensile strength (TS) and the n-value of the steel pipe satisfies the expression (3) below, the volume percentage of its ferrite phase is 75% or more, the average grain size of the ferrite is 10 $\mu$m or more, and the crystal grains of the ferrite having an aspect ratio of 0.5 to 3.0 account for, in area percentage, 90% or more of all the crystal grains composing the ferrite, $$(203\sqrt{C}+15.2Ni-44.7Si-104V-31.5Mo+30Mn+11Cr+20Cu-700P-200Al)<-20 \quad (1)$$

$$(44.7Si+700P+200Al)>80 \quad (2)$$

$$n \geqq -0.126\times\ln(TS)+0.94 \quad (3).$$

10. A method to produce a steel pipe, excellent in formability, according to claim 9 characterized by applying diameter reduction so that the change ratio of the wall thickness of the steel pipe after the diameter reduction to that of the mother pipe is +5% to −30%.

11. A method to produce a steel pipe, excellent in formability, having a chemical composition comprising, in mass, 0.0001 to 0.50% of C, 0.001 to 2.5% of Si, 0.01 to 3.0% of Mn, 0.001 to 0.2% of P, 0.05% or less of S, 0.01% or less of N, 0.2% or less of Ti and 0.15% or less of Nb in a manner to satisfy the expression $0.5 \leqq (Mn+13Ti+29Nb) \leqq 5$, with the balance consisting of Fe and unavoidable impurities, characterized by heating the mother pipe to a temperature of the $Ac_3$ transformation temperature or higher at diameter reduction, applying the diameter reduction under a diameter reduction ratio of 40% or more in the temperature range of the $Ar_3$ transformation temperature or higher, completing the diameter reduction at a temperature equal to or higher than the $Ar_3$ transformation temperature, commencing cooling within 5 sec. after completing the diameter reduction, and cooling the diameter-reduced steel pipe to a temperature of $(Ar_3-100)$° C. or lower at a cooling rate of 5° C./sec. or more, so that the steel pipe has the property that the ratio of the X-ray intensity in the orientation component of {111}<110> on the plane at the center of the steel pipe wall thickness to the random X-ray intensity is 5.0 or larger and the ratio of the X-ray intensity in the orientation component of {111}<112> on the plane at the center of the steel pipe wall thickness to the random X-ray intensity is below 2.0.

12. A method to produce a steel pipe, excellent in formability, having a chemical composition comprising, in mass, 0.0001 to 0.50% of C, 0.001 to 2.5% of Si, 0.01 to 3.0% of Mn, 0.001 to 0.2% of P, 0.05% or less of S, 0.01% or less of N, 0.2% or less of Ti and 0.15% or less of Nb in a manner to satisfy the expression $0.5 \leqq (Mn+13Ti+29Nb) \leqq 5$, with the balance consisting of Fe and unavoidable impurities, characterized by heating the mother pipe to a temperature of the $Ac_3$ transformation temperature or higher at diameter reduction, applying the diameter reduction under a diameter reduction ratio of 40% or more in the temperature range of the $Ar_3$ transformation temperature or higher, subsequently applying another step of the diameter reduction under a diameter reduction ratio of 10% or more in the temperature range from $Ar_3$ to $(Ar_3-100)°$ C., and completing the diameter reduction at a temperature in the range from $Ar_3$ to $(Ar_3-100)°$ C., so that the steel pipe has the property that the ratio of the X-ray intensity in the orientation component of {111}<110> on the plane at the center of the steel pipe wall thickness to the random X-ray intensity is 5.0 or larger and the ratio of the X-ray intensity in the orientation component of {111}<112> on the plane at the center of the steel pipe wall thickness to the random X-ray intensity is below 2.0.

13. A steel pipe, excellent in formability, according to claim 5, characterized in that every one of the r-values in the axial, circumferential and 45° directions is 1.4 or larger.

14. A steel pipe, excellent in formability, according to claim 1, characterized by further containing, in mass, 0.0001 to 2.5% in total of one or more of:

0.0001 to 0.5% of Zr, 0.0001 to 0.5% of Mg, 0.0001 to 0.5% of V, 0.0001 to0.01% of B, 0.001 to 2.5% of Sn, 0.001 to 2.5% of Cr, 0.001 to 2.5% of Cu, 0.001 to 2.5% of Ni, 0.001 to 2.5% of Co, 0.001 to 2.5% of W, 0.001 to 2.5% of Mo, and 0.0001 to 0.01% of Ca.

15. A steel pipe, excellent in formability, according to claim 3, characterized by further containing, in mass, 0.0001 to 2.5% in total of one or more of:

0.0001 to 0.5% of Zr, 0.0001 to 0.5% of Mg, 0.0001 to 0.5% of V, 0.0001 to 0.01% of B, 0.001 to 2.5% of Sn, 0.001 to 2.5% of Cr, 0.001 to 2.5% of Cu, 0.001 to 2.5% of Ni, 0.001 to 2.5% of Co, 0.001 to 2.5% of W, 0.001 to 2.5% of Mo, and 0.0001 to 0.01% of Ca.

16. A steel pipe, excellent in formability, according to claim 5, characterized by further containing, in mass, 0.0001 to 2.5% in total of one or more of:

0.0001 to 0.5% of Zr, 0.0001 to 0.5% of Mg, 0.00001 to 0.5% of V, 0.0001 to 0.01% of B, 0.001 to 2.5% of Sn, 0.001 to 2.5% of Cr, 0.001 to 2.5% of Cu, 0.001 to 2.5% of Ni, 0.001 to 2.5% of Co, 0.001 to 2.5% of W, 0.001 to 2.5% of Mo, and 0.0001 to 0.01% of Ca.

17. A steel pipe, excellent in formability, characterized in that the steel pipe according to claim 1 is plated.

18. A steel pipe, excellent in formability, characterized in that the steel pipe according to claim 3 is plated.

19. A steel pipe, excellent in formability, characterized in that the steel pipe according to claim 5 is plated.

20. A method to produce a steel pipe, excellent in formability, according to claim 7, characterized in that the steel pipe further contains 0.001 to 0.5 mass % of Al.

21. A method to produce a steel pipe, excellent in formability, according to claim 8, characterized in that the steel pipe further contains 0.001 to 0.5 mass % of Al.

22. A method to produce a steel pipe, excellent in formability, according to claim 11, characterized in that the steel pipe further contains 0.001 to 0.5 mass % of Al.

23. A method to produce a steel pipe, excellent in formability, according to claim 12, characterized in that the steel pipe further contains 0.001 to 0.5 mass % of Al.

24. A method to produce a steel pipe, excellent in formability, according to claim 7, characterized in that the steel pipe further contains, in mass, 0.0001 to 2.5% in total of one or more of:

0.0001 to 0.5% of Zr, 0.0001 to 0.5% of Mg, 0.0001 to 0.5% of V, 0.0001 to 0.01% of B, 0.001 to 2.5% of Sn, 0.001 to 2.5% of Cr, 0.001 to 2.5% of Cu, 0.001 to 2.5% of Ni, 0.001 to 2.5% of Co, 0.001 to 2.5% of W, 0.001 to 2.5% of Mo, and 0.0001 to 0.01% of Ca.

25. A method to produce a steel pipe, excellent in formability, according to claim 8, characterized in that the steel pipe further contains, in mass, 0.0001 to 2.5% in total of one or more of:

0.0001 to 0.5% of Zr, 0.0001 to 0.5% of Mg, 0.0001 to 0.5% of V, 0.0001 to 0.01% of B, 0.001 to 2.5% of Sn, 0.001 to 2.5% of Cr, 0.001 to 2.5% of Cu, 0.001 to 2.5% of Ni, 0.001 to 2.5% of Co, 0.001 to 2.5% of W, 0.001 to 2.5% of Mo, and 0.0001 to 0.01% of Ca.

26. A method to produce a steel pipe, excellent in formability, according to claim 9, characterized in that the steel pipe further contains, in mass, 0.0001 to 2.5% in total of one or more of:

0.0001 to 0.5% of Zr, 0.0001 to 0.5% of Mg, 0.0001 to 0.5% of V, 0.0001 to 0.01% of B, 0.001 to 2.5% of Sn, 0.001 to 2.5% of Cr, 0.001 to 2.5% of Cu, 0.001 to 2.5% of Ni, 0.001 to 2.5% of Co, 0.001 to 2.5% of W, 0.001 to 2.5% of Mo, and 0.0001 to 0.01% of Ca.

27. A method to produce a steel pipe, excellent in formability, according to claim 11, characterized in that the steel pipe further contains, in mass, 0.0001 to 2.5% in total of one or more of:

0.0001 to 0.5% of Zr, 0.0001 to 0.5% of Mg, 0.0001 to 0.5% of V, 0.0001 to 0.01% of B, 0.001 to 2.5% of Sn, 0.001 to 2.5% of Cr, 0.001 to 2.5% of Cu, 0.001 to 2.5% of Ni, 0.001 to 2.5% of Co, 0.001 to 2.5% of W, 0.001 to 2.5% of Mo, and 0.0001 to 0.01% of Ca.

28. A method to produce a steel pipe, excellent in formability, according to claim 12, characterized in that the steel pipe further contains, in mass, 0.0001 to 2.5% in total of one or more of:

0.0001 to 0.5% of Zr, 0.0001 to 0.5% of Mg, 0.0001 to 0.5% of V, 0.0001 to 0.05% of B, 0.001 to 2.5% of Sn, 0.001 to 2.5% of Cr, 0.001 to 2.5% of Cu, 0.001 to 2.5% of Ni, 0.001 to 2.5% of Co, 0.001 to 2.5% of W, 0.001 to 2.5% of Mo, and 0.0001 to 0.01% of Ca.

* * * * *